US011607031B2

(12) United States Patent
Magnani et al.

(10) Patent No.: US 11,607,031 B2
(45) Date of Patent: Mar. 21, 2023

(54) RECONFIGURABLE MODULAR BRUSH AND ASSOCIATED BRUSH KITS

(71) Applicants: Mario E. Magnani, Springfield, MA (US); Richard L. Miller, Needham, MA (US); Ryan J. Waters, Boston, MA (US); Brian H. Yoo, Arlington, MA (US)

(72) Inventors: Mario E. Magnani, Springfield, MA (US); Richard L. Miller, Needham, MA (US); Ryan J. Waters, Boston, MA (US); Brian H. Yoo, Arlington, MA (US)

(73) Assignee: CREATIVE HAT, INC., Springfield, MA (US)

( * ) Notice: Subject to any disclaimer, the term of this patent is extended or adjusted under 35 U.S.C. 154(b) by 363 days.

(21) Appl. No.: 16/688,285

(22) Filed: Nov. 19, 2019

(65) Prior Publication Data

US 2020/0170394 A1 Jun. 4, 2020

Related U.S. Application Data

(63) Continuation-in-part of application No. PCT/US2018/033687, filed on May 21, 2018.
(Continued)

(51) Int. Cl.
*A46B 5/00* (2006.01)
*A46B 5/02* (2006.01)
(Continued)

(52) U.S. Cl.
CPC ..... *A46B 5/0095* (2013.01); *A46B 5/0079* (2013.01); *A46B 5/0083* (2013.01);
(Continued)

(58) Field of Classification Search
CPC .... B25G 3/08; B25G 1/06; B25G 3/02; A46B 15/0081; A46B 5/0095
See application file for complete search history.

(56) References Cited

U.S. PATENT DOCUMENTS 1,377,215 A 5/1921 Miller
1,497,495 A 6/1924 Fincke
(Continued)

FOREIGN PATENT DOCUMENTS

CA 2083936 A1 5/1994
GB 2381189 A 4/2003
GB 2385265 A 8/2003

*Primary Examiner* — Shay Karls

(74) *Attorney, Agent, or Firm* — Louis J. Franco; Law Office of Louis J. Franco

(57) ABSTRACT

A reconfigurable modular brush has a brush head including brush-head upper and lower surfaces extending longitudinally along a brush-head axis between brush-head first and second ends. Laterally opposed brush-head first and second sides extend between the brush-head upper and lower surfaces and longitudinally between the brush-head first and second ends. A bristle array is defined by a plurality of bristles protruding from the brush-head lower surface. A brush handle includes a grip portion and a brush-head mount, the brush handle having a lengthwise extent disposed generally along a handle axis between handle proximate and distal ends. The brush head and brush-head mount are cooperatively configured such that the handle can selectively
(Continued)

capture and retain the brush head. Moreover, the longitudinal orientation in which the brush head is captured and retained by the brush handle is selectively reversible.

11 Claims, 16 Drawing Sheets

Related U.S. Application Data

(60) Provisional application No. 62/508,737, filed on May 19, 2017.

(51) Int. Cl.

| | |
|---|---|
| ***A46B 7/04*** | (2006.01) |
| ***A46B 9/02*** | (2006.01) |
| ***A46B 9/06*** | (2006.01) |
| ***A46B 15/00*** | (2006.01) |
| ***B08B 1/00*** | (2006.01) |
| ***B25G 1/06*** | (2006.01) |

(52) U.S. Cl.

CPC ..... *A46B 5/02* (2013.01); *A46B 7/042* (2013.01); *A46B 7/046* (2013.01); *A46B 9/025* (2013.01); *A46B 9/06* (2013.01); *A46B 15/0093* (2013.01); *B08B 1/002* (2013.01); *B08B 1/005* (2013.01); *B25G 1/06* (2013.01); *A46B 2200/30* (2013.01)

(56) References Cited

U.S. PATENT DOCUMENTS

| | | | | |
|---|---|---|---|---|
| 3,720,976 | A * | 3/1973 | Bailey | A47L 13/46 15/244.2 |
| 4,155,140 | A * | 5/1979 | Janssen | B05C 17/00 15/145 |
| 4,575,894 | A | 3/1986 | Stevens | |
| 4,754,516 | A | 7/1988 | Tremblay | |
| 5,224,234 | A | 7/1993 | Arsenault | |
| 5,864,915 | A | 2/1999 | Ra | |
| 5,875,511 | A * | 3/1999 | Nejdl | A47K 7/028 15/176.1 |
| 6,237,183 | B1 | 5/2001 | Fischer | |
| 6,240,590 | B1 * | 6/2001 | Nesbit | A46B 17/02 15/145 |
| 6,332,235 | B1 | 12/2001 | Lye | |
| 6,546,585 | B1 | 4/2003 | Blaustein | |
| 6,588,045 | B2 | 7/2003 | Fernandez | |
| 9,038,224 | B1 * | 5/2015 | Esquibel | A46B 13/023 15/22.1 |
| 2002/0148058 | A1 | 10/2002 | Greenwood | |
| 2004/0003479 | A1 | 1/2004 | Ornelas et al. | |
| 2004/0068810 | A1 | 4/2004 | Lee | |
| 2006/0123955 | A1 | 6/2006 | Cho | |
| 2006/0168746 | A1 * | 8/2006 | Guyuron | A47K 7/04 15/97.1 |
| 2007/0214587 | A1 | 9/2007 | Stoeffler et al. | |
| 2009/0235475 | A1 | 9/2009 | Bohannan et al. | |

* cited by examiner

Reciprocating saw adapter with integral slide rails and ¼ turn captive screw fastener Reciprocating saw adapter attached to modular brush head 210
242
240
246
245
200, 200C
243

82
86
72
70
$A_H$
97
95
89
275
55
248
22
88
$A_{BH}$
84
74
53, 53$_R$
22
32
22
34
45
48A
10
20
56A
$A_{TD}$
53, 53$_R$
48B
56B
24

84
88
72
70
89
74

FIG. 13
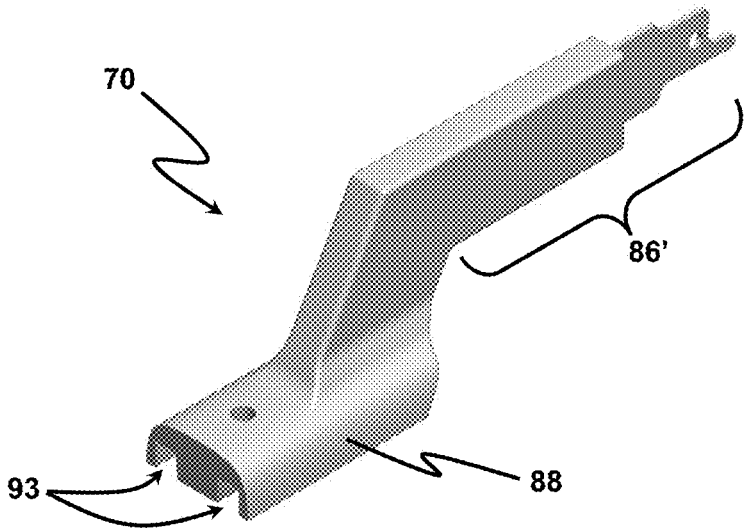
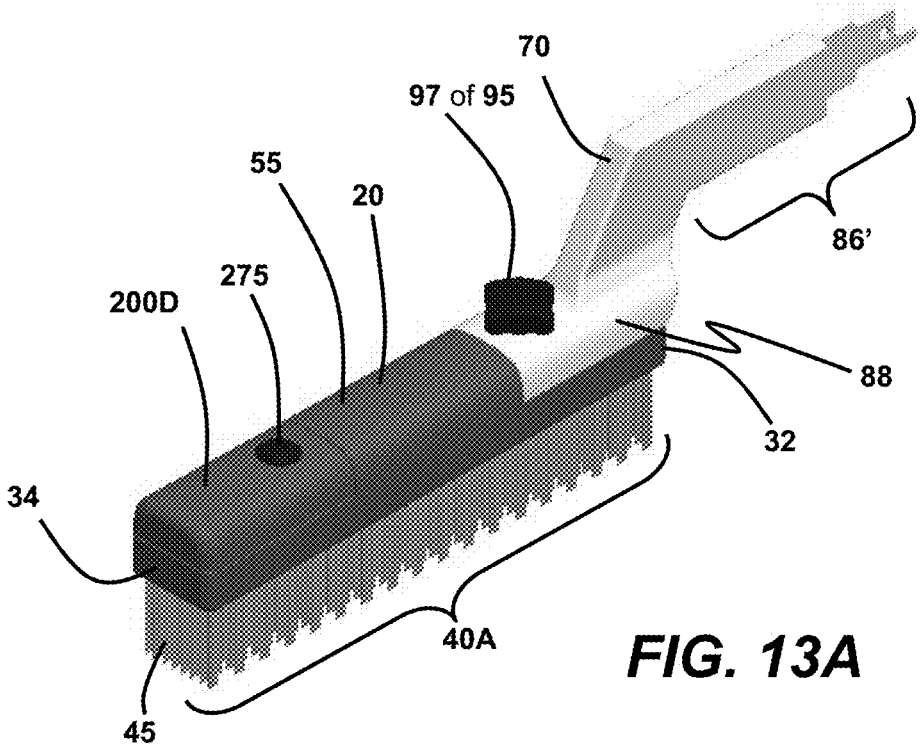
FIG. 13A

RECONFIGURABLE MODULAR BRUSH AND ASSOCIATED BRUSH KITS

CROSS-REFERENCE TO RELATED APPLICATION/PRIORITY CLAIMS

The present application is a continuation-in-part of International Application Serial No. PCT/US2018/033687 filed May 21, 2018 pursuant to the Patent Cooperation Treaty, and under the title "RECONFIGURABLE MODULAR BRUSH AND ASSOCIATED BRUSH KITS." Application PCT/US2018/033687 claimed priority benefits in U.S. Provisional Application No. 62/508,737 filed May 19, 2017 under the title "RECONFIGURABLE MODULAR BRUSH AND ASSOCIATED BRUSH KITS."

The present application claims the benefit of the filing date of Provisional Application Ser. No. 62/508,737, as well as the filing date of PCT Application No. PCT/US2018/033687, based on the priority chain outlined above. Moreover, the entireties of the disclosures, including the drawings, of both previous applications in the aforesaid priority chain are incorporated herein by reference as if set forth fully in the present application.

Although the present application was identified at filing as a "continuation-in-part" application, this identification does not constitute an admission that the present application contains "new matter" not fairly supported in parent Application No. PCT/US2018/033687 or Provisional Application Ser. No. 62/508,737.

BACKGROUND

Brushes having bristles of metal, nylon, or other materials are fabricated for various functions including scraping, stripping, scrubbing, and sweeping. A project-specific set of brushes may be used for the removal of rust, paint, and debris from wood, metal and other surfaces in order to prepare them for repainting, for example. A typical brush is fabricated and sold as a single unitary structure in which the bristles, the bristle-retaining brush head and a handle are mutually inseparable. Because of this, homeowners and professionals are required to possess several brushes of different sizes and types in order to perform project related tasks. Moreover, during normal use, the bristles located closest to the leading edge (the distal end relative to a user) of the brush wear at a much faster rate than those located farther back. As a result, brushes are frequently discarded—handle and all—after the forwardmost bristles are worn, but with the bristles located nearest the handle still in near-new condition.

Accordingly, a need exists for a reconfigurable modular brush and brush system that, in at least one aspect, allows a user to separate a bristle-retaining brush head from a handle and remount the bristle-retaining brush head to the handle such that which end of the first and second ends of the bristle-retaining head serves as the "leading end" of the overall brush is reversible.

SUMMARY

In a first embodiment generally illustrative of the invention, a reconfigurable modular brush includes a brush head and a brush handle cooperatively configured such that the brush handle can selectively capture and retain the brush head. The brush head includes brush-head upper and lower surfaces extending longitudinally along a brush-head axis between brush-head first and second ends and laterally opposed brush-head first and second sides extending between the brush-head upper and lower surfaces and longitudinally between the brush-head first and second ends. The brush head further includes at least one bristle array defined by a plurality of bristles protruding from the brush-head lower surface.

The brush handle includes a grip portion which, in each of various versions, is configured for grasping by a human hand. Depending from the grip portion is a brush-head mount by which the brush head can be selectively captured and retained. The brush handle has a lengthwise extent disposed generally along a handle axis between handle proximate and distal ends.

In each of various embodiments, the brush head and brush-head mount are keyed in complementary fashion for mutual selective interlocking. The selective interlock prevents undesired lateral, longitudinal, and angular displacement of the brush head relative to the brush head mount. Moreover, the brush head and brush-head mount are configured such that the longitudinal orientation in which the brush head is captured and retained by the brush handle is selectively reversible.

Among alternative embodiments, the brush head includes bristles varying in length, thickness, coarseness, and material, for example. Moreover, in some versions, the bristles of a single brush head are arranged in disparate bristle arrays comprised of mutually disparate bristles. Illustrative examples of disparately configured brush heads and bristle arrays are addressed later in the detailed description. Presently, however, it is noted that bristle arrays comprising bristles of disparate types, sizes, and materials facilitate use of a reconfigurable modular brush in a broader scope of applications, from general cleaning and scrubbing of surfaces, to surface preparation for painting, to cleaning the grates of cooking grills.

Alternative embodiments may manifest in the form of brush kits, each of which kits is comprised of at least one brush handle that accepts a variety of brush heads. The brush heads could vary is shape, size, bristle-type, bristle-array configuration, and bristle material, for example. It is envisioned that a handle could be retained and, when brush heads wear out, or different brush heads and bristle types are required, additional brush heads compatible with the handle could be purchased as replacements and/or additions.

The precise mechanisms and configurations by which the brush head and brush-head mount are keyed in complementary fashion for mutual selective interlocking is a somewhat secondary matter in some embodiments, and of more prominent, or even primary, importance in others. According to one illustrative example, the brush-head mount comprises laterally opposed, inwardly projecting, and longitudinally extending tongues. Defined along each of the brush-head first and second sides is a longitudinally extending groove. The groves are laterally opposed, configured, and spaced to selectively receive by longitudinal insertion the tongues in order to facilitate capture and retention of the brush head by the brush-head mount. In each of some versions, a partially open slot is defined by and between the opposed tongues, and selective capture and retention of the brush head by the brush-head mount is achieved by longitudinal insertion into the partially open slot of the brush head in a rearward direction generally toward the handle proximate end.

As previously described, various embodiments are configured such that the longitudinal orientation of the brush head relative to the handle is reversible. In other words, the brush-head mount can alternatively capture and retain the brush head in a first longitudinal orientation and a second longitudinal orientation constituting the reverse of the first longitudinal orientation. In an embodiment including a partially open slot defined between tongues, the first and second longitudinal orientations are alternatively achieved by inserting, respectively, the brush-head first and second ends into the partially open slot. At least one version further includes a heel extending downwardly from the brush-handle bottom surface and configured to arrest by contacting engagement the rearward displacement of the brush head when inserted within the partially open slot.

In a still additional embodiment, the brush-head mount is selectively rotatable relative to the grip portion between first and second angular orientations. The first angular orientation corresponds to one of a locked position and an unlocked position, while the second angular orientation corresponds to the other of a locked and unlocked position. The locked position is such that, when disposed between and on the tongues, the brush head is restrained against axial displacement relative to the brush-head mount. Conversely, the unlocked position is such that the brush head can be alternatively axially displaced relative to the brush-head mount for insertion or removal.

In one version in which the brush-head mount is selectively rotatable relative to the grip portion, the first angular orientation is such that the handle axis and brush head axis are coplanar and the second angular orientation is such that the handle axis and brush head axis are non-coplanar. In a more specific instance, the second angular orientation is such that the handle and bush head axes are mutually orthogonal.

Representative embodiments are more completely described and depicted in the following detailed description and the accompanying drawings.

BRIEF DESCRIPTION OF THE DRAWINGS

FIG. 13 shows a mounting adaptor configured alternatively to the mounting adaptor of FIGS. 8 and 9; and FIG. 13A depicts the mounting adaptor of FIG. 13 coupled to a brush head like the brush head of FIG. 11.

DETAILED DESCRIPTION

Figure 1:
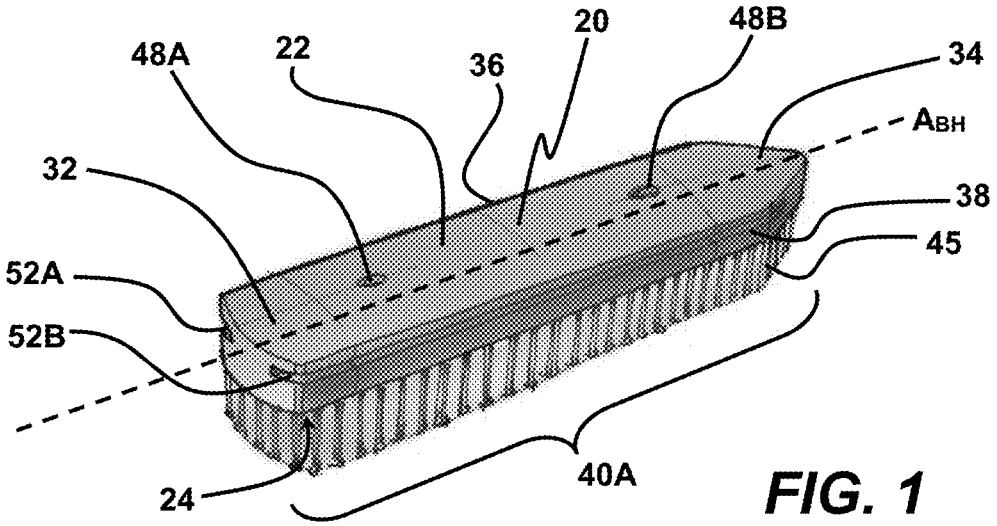
FIG. 1 depicts a brush head configured for cooperative capture and retention by a handle.

The following description of variously configured and reconfigurable modular brushes and brush systems is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to restrict the maximum scope of the claims.

Shown in the included drawings are various views and illustrative versions of "reconfigurable modular brushes" or "modular brush assemblies/kits," generally referenced by the reference number 10. A basic, first embodiment is described with general reference to FIGS. 1 and 2. Moreover, for the sake of efficiency and descriptive clarity, illustrative, non-limiting additions, optional features, and alternative configurations of various elements are described with conjunctive reference to the basic illustrative configuration of the embodiment of FIGS. 1 and 2. Additionally, throughout the specification and drawings, like elements across alternative embodiments are referenced by similar or identical numeric and/or alphanumeric reference characters.

With initial reference to FIG. 1, a bristle-retaining brush head 20 (alternatively referred to as "brush head 20") includes brush-head upper and lower surfaces 22 and 24 extending longitudinally along a brush-head axis $A_{BH}$ between brush-head first and second ends 32 and 34. Additionally, extending between the brush-head upper and lower surfaces 22 and 24, and longitudinally along the brush-head axis $A_{BH}$ between brush-head first and second ends 32 and 34 are laterally opposed brush-head first and second sides 36 and 38.

Retained by the brush head 20, and protruding from the brush-head lower surface 24 thereof, is at least a first bristle array 40A comprising a plurality of bristles 45. While the initial designation of the brush-head first and second ends 32 and 34 is, of course, entirely arbitrary, in the example of FIG. 1, the brush-head first end 32 is the end having a "generally rectangular, though slightly convex arcuate configuration," while the brush-head second end 34 is that end that tapers toward a point. It will be readily appreciated that these end configurations are merely illustrative in nature and are unrelated to the precise point(s) of novelty, as implementations within the scope of the invention can be variously configured.

Figure 2:
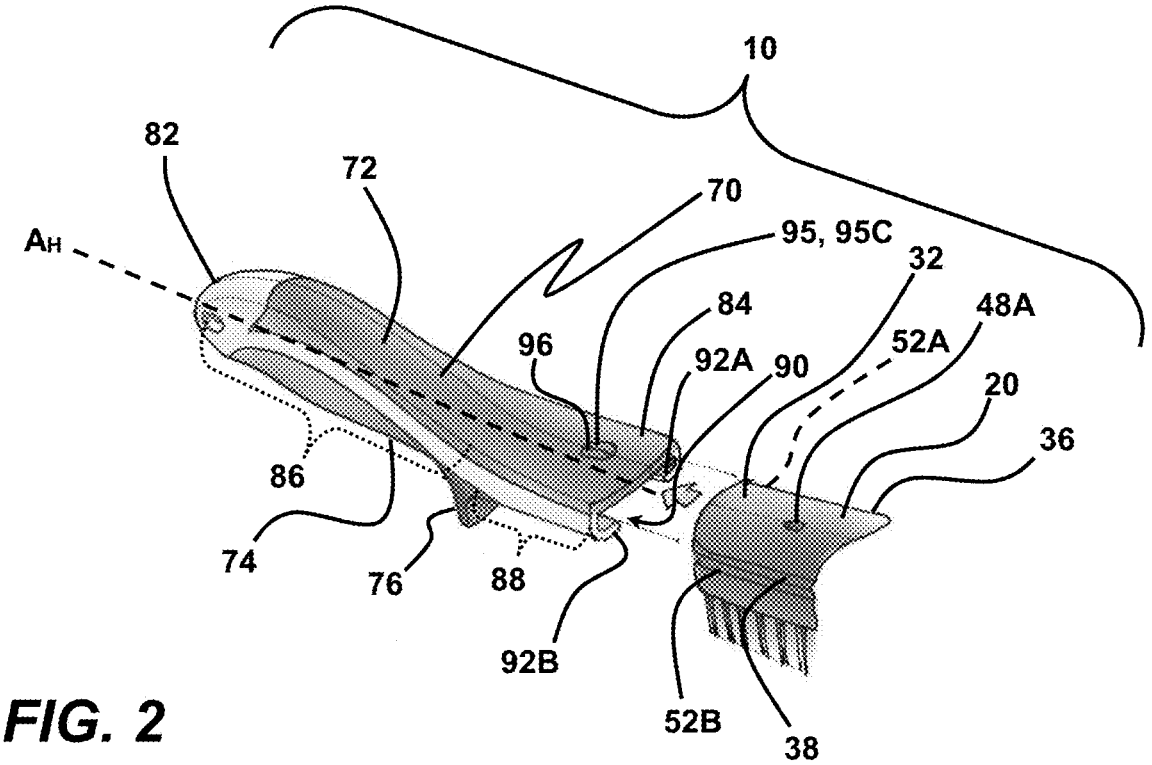
FIG. 2 shows a brush head of the type in FIG. 1 being axially inserted for capture and retention by a brush-head mount of a brush handle.

Referring now to FIG. 2, an illustrative modular brush 10 further includes a brush handle 70 having brush-handle top and bottom surfaces 72 and 74 which, while contoured, have a lengthwise extent disposed generally along a handle axis $A_H$ between handle proximate and distal ends 82 and 84. The brush handle 70 further includes a grip portion 86 configured for grasping by a human hand and a brush-head mount 88. The brush-head mount 88 and the brush head 20 are cooperatively configured such that the brush handle 70 can selectively capture and retain the brush head 20. Although the particular configurations and mechanisms through which selective capture and retention are achieved are of ancillary concern, at least in some embodiments, a common goal across embodiments is to restrain the brush head 20 against lateral, longitudinal and pivotal movement of the brush head 20 relative to the brush handle 70. Moreover, the retaining mechanisms and complementary configurations of the brush head 20 and brush handle 70 are such that the longitudinal orientation of the brush head 20 is reversibly retainable by the brush handle 70.

In FIG. 2, the brush-head first end 32 of a brush head 20 like that shown in FIG. 1 is being inserted into a partially open slot 90 defined within the brush-head mount 88 by a pair of laterally opposed, inwardly projecting, and longitudinally extending tongues 92A and 92B depending from the brush-handle bottom surface 74. The tongues 92A and 92B are received by laterally opposed grooves 52A and 52B defined within, and extending longitudinally along, respectively, the brush-head first and second sides 36 and 38. As the brush head 20 is longitudinally inserted into the partially open slot 90 defined by and between the opposed tongues 92A and 92B, its rearward motion is ultimately arrested by a heel 76 that extends downwardly from the brush-handle bottom surface 74. More specifically, in the scenario depicted in FIG. 2, the rearward displacement of the brush head 20 will be limited by contacting engagement between the brush-head first end 32 and the heel 76.

While the heel 76 prevents rearward longitudinal displacement of the brush-head first end 32 toward the handle proximate end 82 beyond a predetermined point, there is also the need to prevent the forward longitudinal displacement of the brush head 20 away from the heel 76 in order to prevent unwanted separation of the brush head 20 from the brush handle 70. Selective retention of the brush head 20 by the brush handle 70 can be achieved through various alternative fastening mechanisms (fasteners 95) including, by way of non-limiting example, a mechanically-biased pin, a cam bolt or, as in the case shown for illustrative purposes, a threaded fastener 95.

In order to retain the brush head 20 within the brush handle 70, the threaded fastener 95 is selectively disposed into one of a plurality of fastener-receiving apertures 48 (e.g., 48A and 48B) defined within the brush-head upper surface 22. In this case, the suggested type of threaded fastener 95 is a captive fastener 95C ideally requiring only a fractional turn (i.e., less than one full rotation) to fully engage with internal threads (not shown) defined within each of the fastener-receiving apertures 48. Moreover, the threaded fastener 95 may include a keyed fastener head 96 that can be engaged by a tool such as a screwdriver or hex key (not shown) and which is recessed or flush relative to the brush-handle top surface 72 when retainably engaging the brush head 20. Thusly configured, the fastener 95—and specifically the fastener head 96—will not constitute an uncomfortable or dangerous protrusion to a person grasping the brush handle 70 to engage a work surface. Although a fastener 95 with a recessed or flush keyed fastener head 96 may be preferred in various embodiments, tool-less options that are not flush or recessed relative to the brush-handle top surface 72 are also within the scope and contemplation of the invention, and an example is provided later in the present description with reference to FIG. 10.

Figure 3:
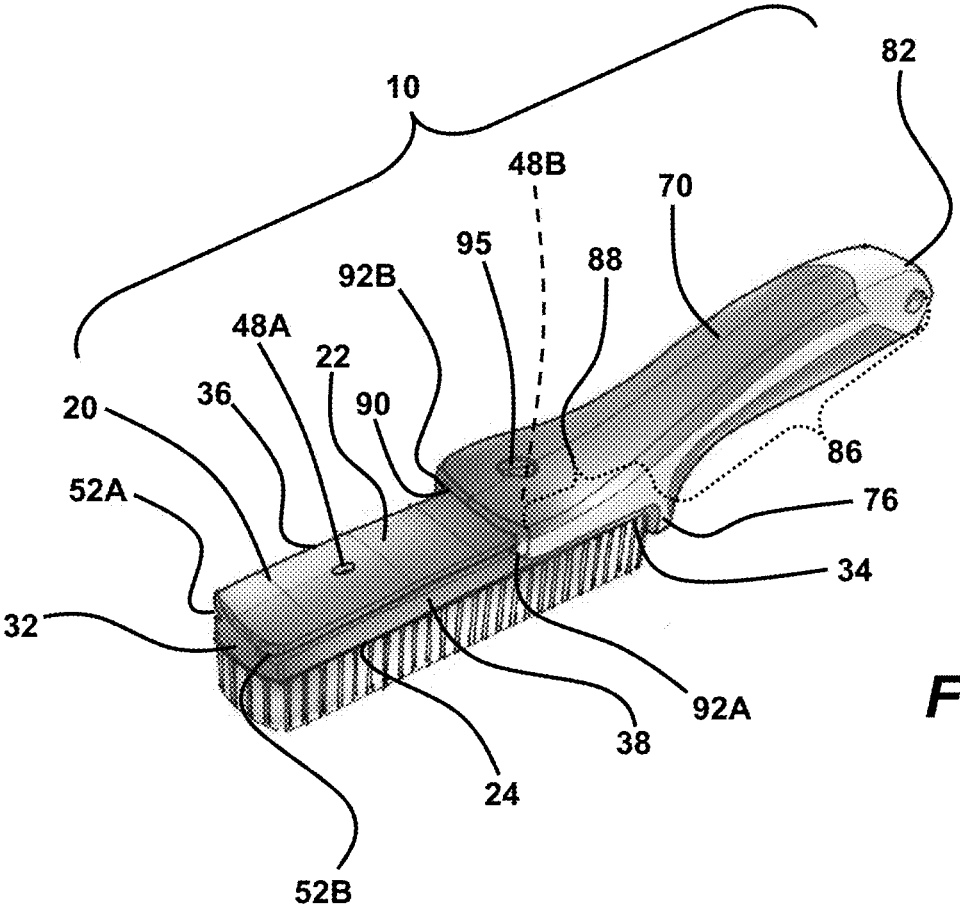
FIG. 3 shows a brush head selectively retained by a brush handle.

Referring now to FIG. 3, the longitudinal orientation of the brush head 20 has been reversed relative to the position in which it is being inserted into the brush handle 70 in FIG. 2. More specifically, in FIG. 3, the brush-head second end 34 has been inserted into the partially open slot 90 defined by and between the tongues 92A and 92B. In this second longitudinal orientation, the brush head 20 is restrained against longitudinal displacement within the slot 90 by the engagement of the fastener 95 with an internally-threaded second aperture 48B defined in the upper surface of the brush head 20. Note that the internally-threaded aperture is shown in FIG. 1 and indicated by a dashed lead line in FIG. 3.

As previously indicated, the brush head 20 may be of various alternative configurations. In the illustrative example considered in conjunction with FIGS. 1-3, the brush-head first end 32, while slightly radiused, is generally as wide as the brush head 20 overall. However, toward the brush-head second end 34, the brush-head first and second sides 36 and 38 mutually converge to define a generally pointed brush-head second end 34 that enables brushing in corners and tighter spaces than is possible with the brush-head first end 32. Moreover, the bristles 45 of the embodiment of FIGS. 1-3 are similar throughout the single bristle array 40A extending between the brush-head first and second ends 32 and 34.

Figure 4A:
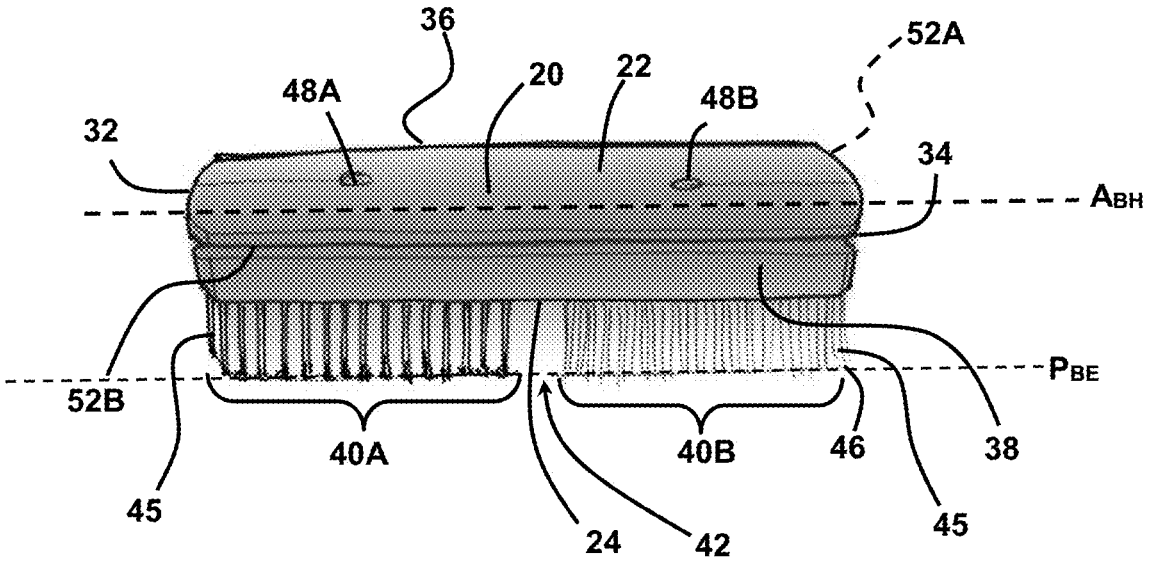
FIG. 4A is a side view of a brush head having two distinct bristle arrays comprising disparately configured bristles with bristle free ends aligned among a common, single bristle-end plane.
Figure 4B:
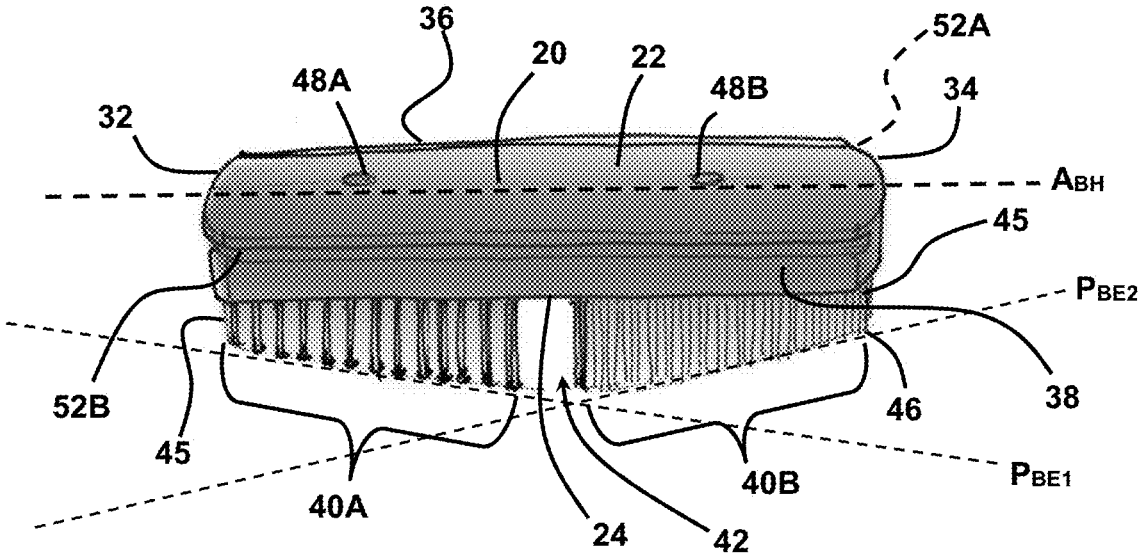
FIG. 4B is a side view of a brush head having two distinct bristle arrays comprising disparately configured bristles with bristle free ends aligned along mutually distinct bristle-end first and second planes.

Shown in FIGS. 4A and 4B are two alternatively configured brush heads 20 that can be used cooperatively, and reversibly, with a brush handle 70. In the version of FIG. 4A, distinct first and second bristle arrays 40A and 40B are defined. The bristle arrays 40A and 40B are mutually distinct not only because they are separated by a bristle-array gap 42, but because the bristles 45 of the first bristle array 40A are distinct from those in the second bristle array 40B. More specifically, the bristles 45 of the first bristle array 40A are coarser than the finer bristles 45 of the second bristle array 40B. Also of note in the version of FIG. 4A is that the bristle free ends 46 (i.e., the bristle ends that engaged a work surface) of the bristles 45 of both the first and second bristle arrays 40A and 40B terminate generally along a single bristle-end plane $P_{BE}$ that is itself generally parallel to the brush-head lower surface 24.

As in the version of FIG. 4A, the illustrative brush head 20 of FIG. 4B includes mutually distinct first and second bristle arrays 40A and 40B. While the bristles 45 of bristle arrays 40A and 40B in the version of FIG. 4B are similar to the bristles 45 of, respectively, the bristle arrays 40A and 40B in the version of FIG. 4A, the configurations of the bristle arrays 40A and 40B differ between the two versions. More specifically, the bristle free ends 46 of the bristles 45 of the first and second bristle arrays 40A and 40B terminate generally along, and define, respectively, bristle-end first and second planes $P_{BE1}$ and $P_{BE2}$. As clearly indicated in FIG. 4B, the bristle-end first and second planes $P_{BE1}$ and $P_{BE2}$ are mutually non-parallel, and each of the planes $P_{BE1}$ and $P_{BE2}$ is furthermore non-parallel to the brush-head lower surface 24.

With more detailed reference to FIG. 4B, the bristle-end first plane $P_{BE1}$ is titled relative to the brush-head lower surface 24 such that the shortest of the bristles 45 of the first bristle array 40A that terminate along and define the bristle-end first plane $P_{BE1}$ are the bristles 45 of the first bristle array 40A closest the brush-head first end 32. Accordingly, in moving longitudinally along the brush-head axis $A_{BH}$ from the bristles 45 of the first bristle array 40A nearest the brush-head first end 32 toward the bristles 45 of the first bristle array 40A nearest the second bristle array 40B, the bristles 45 increase in length. In analogous fashion, the bristle-end second plane $P_{BE2}$ is titled relative to the brush-head lower surface 24 such that the shortest of the bristles 45 of the second bristle array 40B are closest the brush-head second end 34. Accordingly, in moving longitudinally along the brush-head axis $A_{BH}$ from the bristles 45 of the second bristle array 40B nearest the brush-head second end 34 toward the bristles 45 of the second bristle array 40B nearest the first bristle array 40A, the bristles 45 increase in length.

Configuring the first and second bristle arrays 40A and 40B such that the bristle-end first and second planes $P_{BE1}$ and $P_{BE2}$ are titled relative to the brush-head lower surface 24 as described facilitates brush-stroke efficiency and increased bristle life. More specifically, it will be readily appreciated that when one uses a brush such as a grill brush to clean the rails defining a grill grate, he or she frequently tilts the brush at an angle such that only the bristles farthest from the user engage the work surface (i.e., the grill grate in the current example). Such use results in only a fraction of the bristles engaging the work surface. This, in turn, results in (i) increased wear and shortened bristle life of the most distal bristles and (ii) more strokes required to clean the work surface since fewer bristles are engaging same. It will be furthermore appreciated that such a brush is typically disposed of with most of its bristles intact. By accommodating and compensating for a user's natural propensity to tilt a brush as described while cleaning a work surface, the corresponding tilts (i.e., tilt angles) of the bristle-end first and second planes $P_{BE1}$ and $P_{BE2}$ facilitate more natural engagement of a work surface by more bristles 45 with each cleaning stroke, thereby increasing both the effectiveness of each stroke (i.e., efficiency) and bristle life through the distribution of the working load over a larger number of bristles 45.

Figure 5:
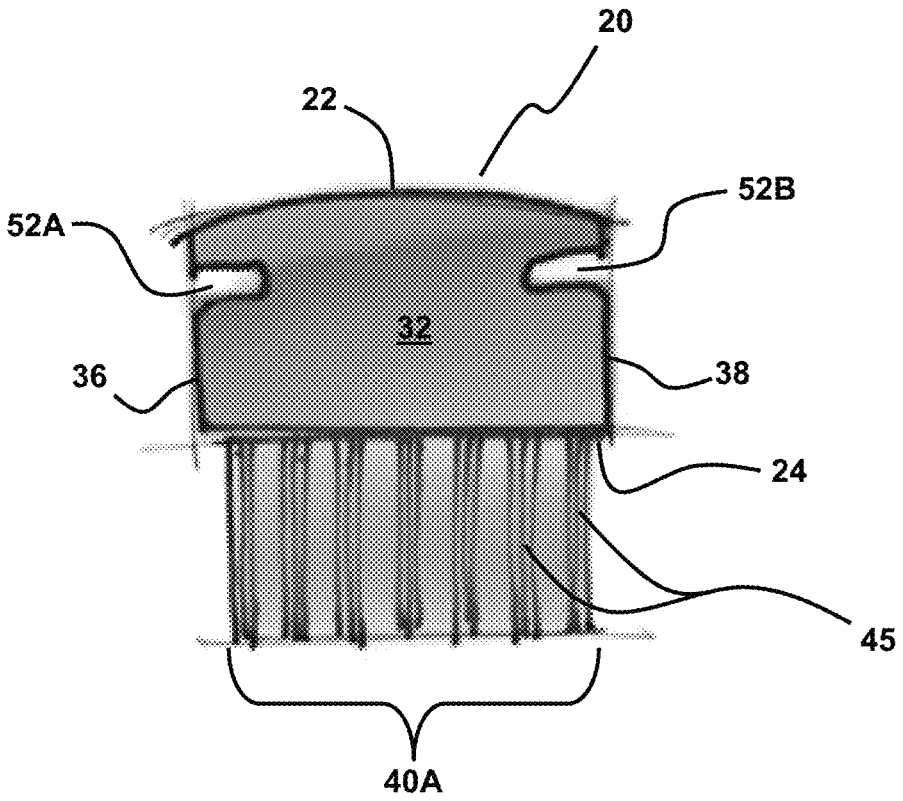
FIG. 5 is an end view of a brush head including groves for selectively receiving tongues defined on a brush-head mount of a brush handle.

Various embodiments are configured such that, when separated from the brush handle 70, the brush head 20 can be grasped directly within a user's palm and multiple fingers of the same hand to engage/scrub a work surface. That is, in each of various versions, the brush head 20, when removed from the brush handle 70, can itself be used a standalone hand brush. Although even a basic brush head 20 with a relatively flat, planar brush-head upper surface 22 could fulfill the function of a user's grasping it directly with his or her hand and using it separately from the brush handle 70, alternative configurations are rendered more ergonomic in order to provide comfort and facilitate grip. By way of illustrative, non-limiting example, reference is made to FIG. 5 in which there is depicted an end view taken from the brush-head first end 32 of a brush head 20 having a brush-head upper surface 22 with a convex profile extending between the laterally opposed brush-head first and second sides 36 and 38. It will be readily appreciated that such a profile is "more ergonomic" than a flat brush-head upper surface 22. As previously indicated, any element referenced by a reference number not explicitly described or discussed in connection with FIG. 5 corresponds to the same or similar element described in association with previous figures and referenced by the same reference number.

Figure 6:
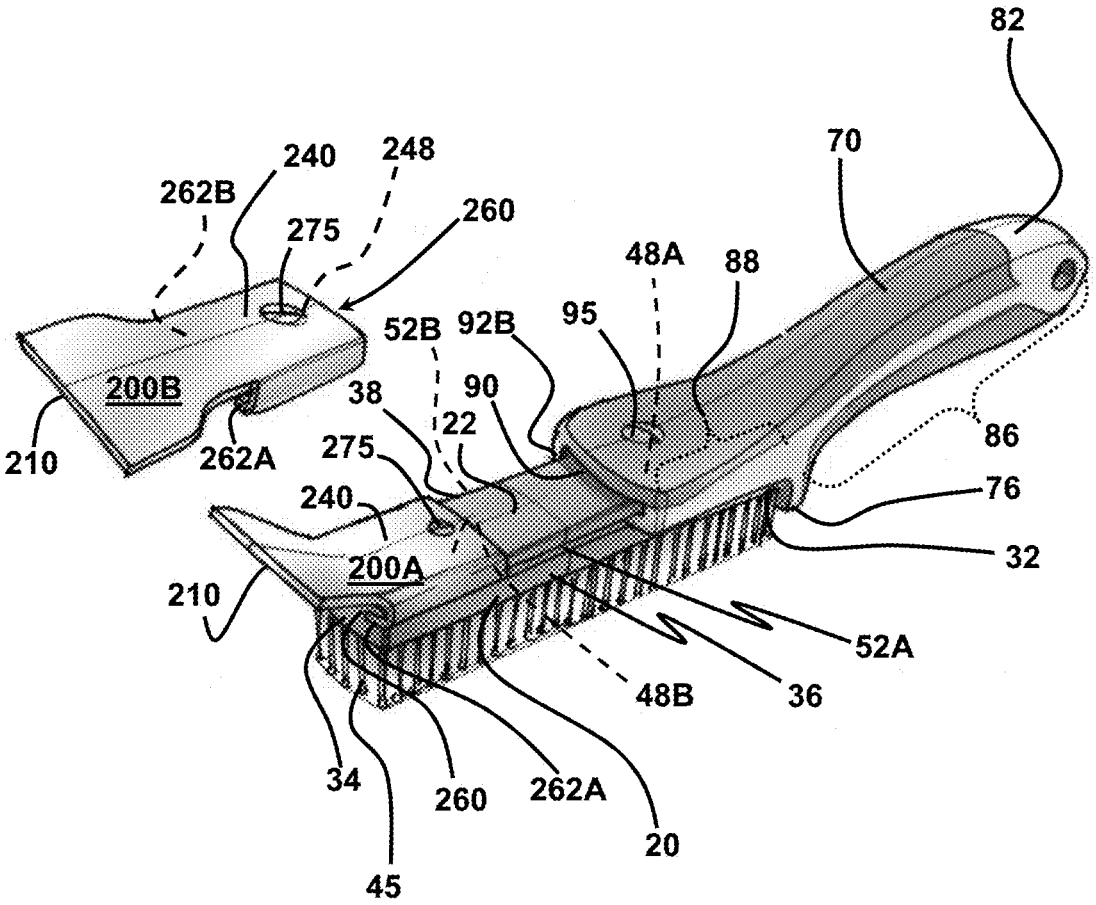
FIG. 6 is a perspective view of a cooperatively interlocked brush head and brush handle further showing accessories in the form of scraping blades configured for mounting on an end of the brush head not captured by the brush handle.

In addition to removability, reversibility, and replaceability of brush heads 20, various embodiments provide for the temporary attachment of accessories, or implements, to the brush-head end 32 or 34 not retained by the brush handle 70. By way of illustrative, non-limiting example, FIG. 6 shows two alternative scrapers 200A and 200B that can be selectively attached to the depicted brush head 20. While the scrapers 200A and 200B have disparate task-specific blades 210, each has an accessory base 240 that is configured for selective mounting to the "free end" of the brush head 20 (i.e., that end 32 or 34 not retained by the brush handle 70) in a manner very similar to that in which the brush head 20 is attached to the brush handle 70.

As an exemplary embodiment, each of the scrapers 200A and 200B shown in FIG. 6 includes an accessory base 240 configured for capture and retention by the brush head 20. The accessory base 240 includes a pair of laterally opposed, inwardly projecting, and longitudinally extending tongues 262A and 262B which combine to define a partially open slot 260. As with the opposed and parallel tongues 92A and 92B of the brush handle 70, the mutually parallel tongues 262A and 262B of the accessory base 240 are received by the laterally opposed grooves 52A and 52B defined within, and extending longitudinally along, respectively, the brush-head first and second sides 36 and 38. The longitudinal position of the accessory base 240 relative to the brush head 20 may then be releasably set by an accessory fastener 275 which may take a number of alternative forms including, by way of example, a pin, a "free" threaded fastener such as a screw, or a captive threaded fastener. In the example shown, the fastener 275 is a screw that is fed through an aperture 248 in the accessory base 240 and is threaded into fastener-receiving aperture 48B defined on the brush head 20.

In the illustrative configurations thus far shown and described, the brush handle 70 and brush head 20, when selectively coupled, form an "in-line" configuration in which the grip portion 86 of the brush handle 70 is situated generally to the rear—or at least primarily to the rear—of the brush head 20. Stated alternatively, when mounted within the brush-head mount 88, at least a majority of the length of the brush head 20 extends forward of the grip portion 86. However, it is to be understood that this need not be the case, and illustrative alternative configurations are described below in conjunction with the figures indicated.

Figure 7:
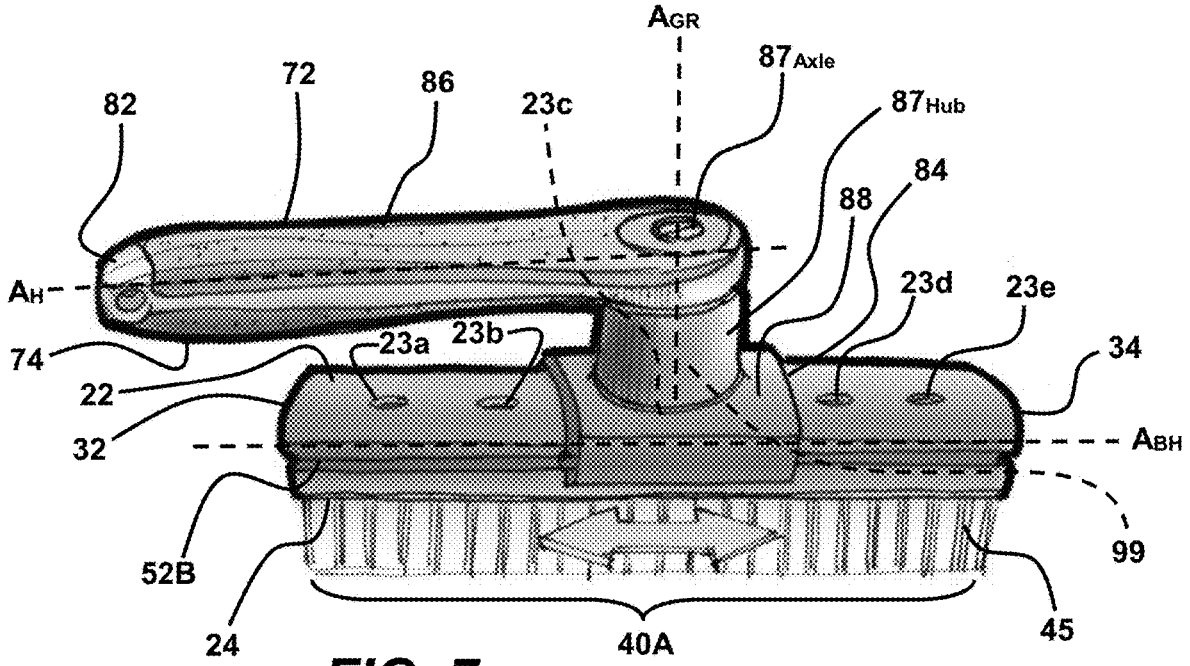
FIG. 7 is a first view of a reconfigurable modular brush in which the operative axial position of the brush head relative to the brush-head mount is variable.
Figure 7A:
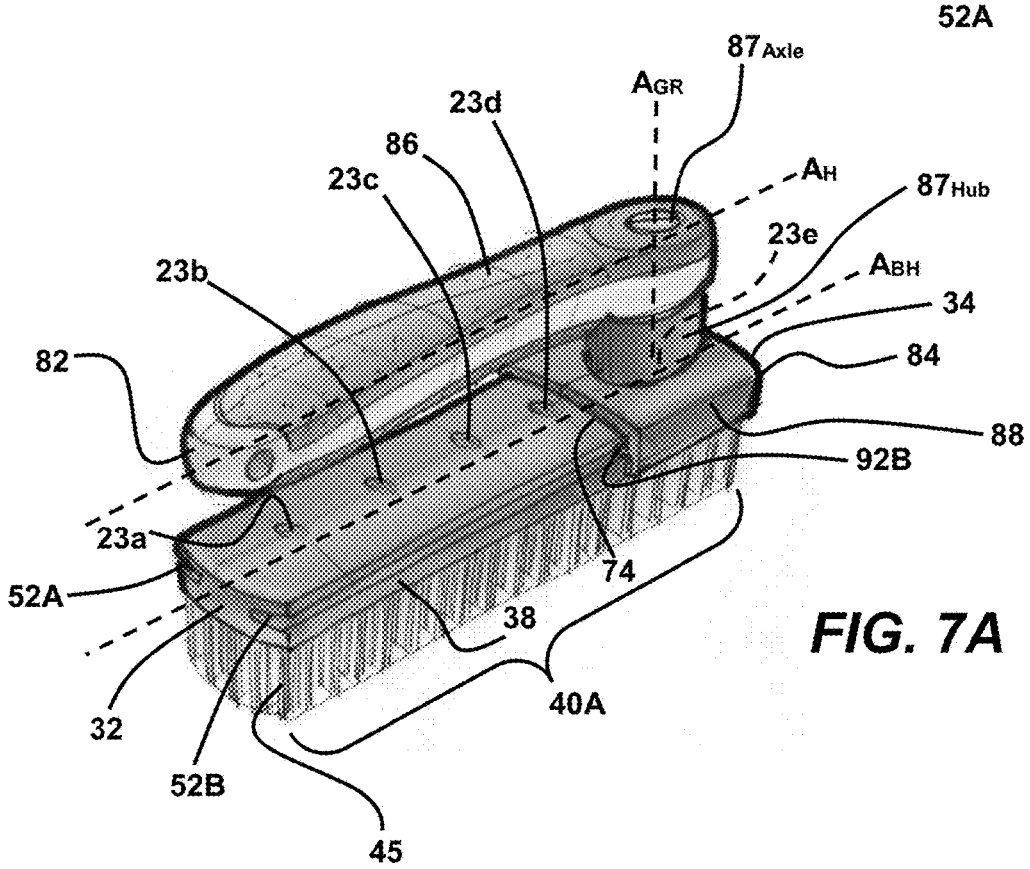
FIG. 7A shows a second view of the reconfigurable modular brush of FIG. 7 in which the brush head is in an operative axial position relative to the brush-head mount different from the operative axial position depicted in FIG. 7.
Figure 7B:
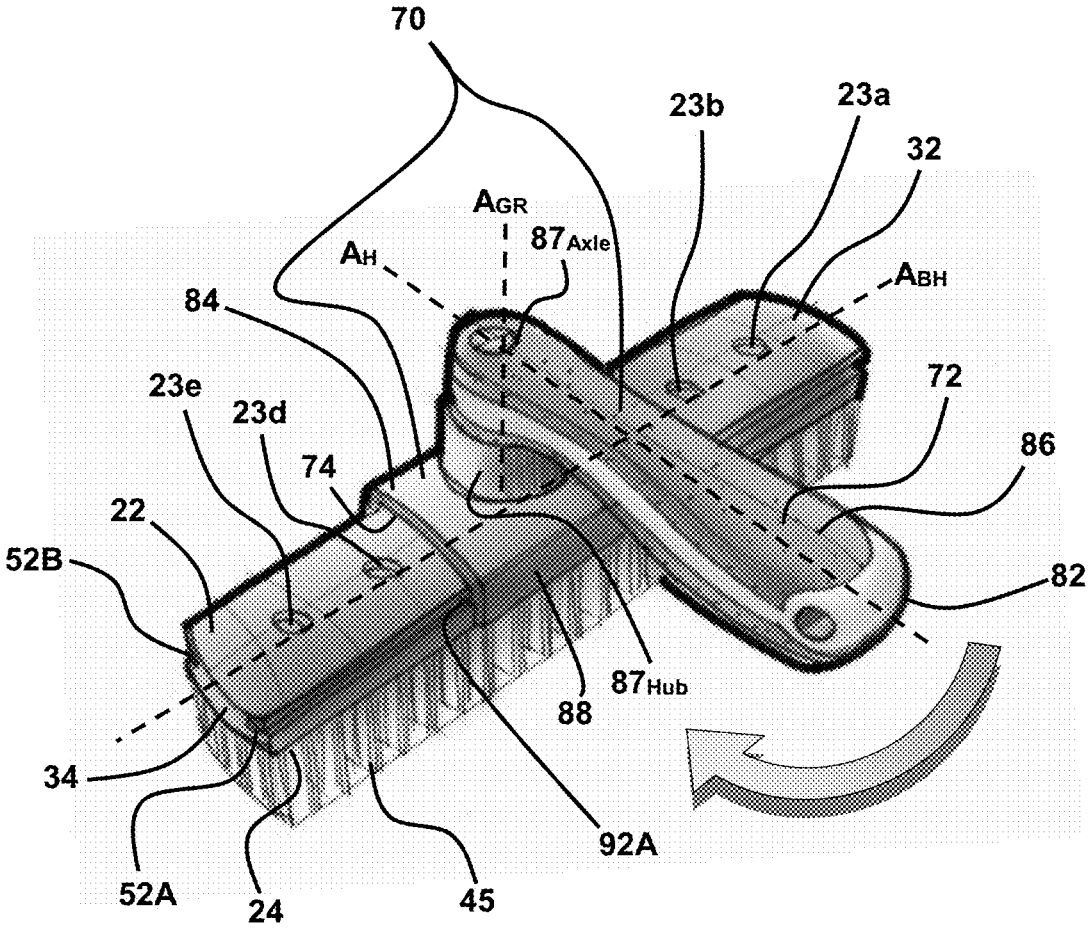
FIG. 7B shows the version of reconfigurable modular brush of FIGS. 7 and 7A, but further illustrating that the grip portion of the handle is pivotable relative to the brush-head mount of the handle.

With conjunctive reference to FIGS. 7, 7A and 7B, there is described an embodiment of a reconfigurable modular brush 10 in which the operative axial position (longitudinal position along the brush-head axis $A_{BH}$, for example) of the brush head 20 relative to the brush-head mount 88 is variable (indicated by two-headed arrow). In FIG. 7, the brush head 20 is depicted as roughly centered within the brush-head mount 88, whereas, in FIG. 7A, the brush-head mount 88 is shown in a position toward an end—the brush head second end 34 in this case—of the brush head 20, and with a major extent of the length of the grip portion 86 extending over the brush-head upper surface 22.

In the version of FIGS. 7 and 7A, a plurality of discrete operative lineal positions for the brush head 20 relative to the brush-head mount 88 is indicated by positioning detents 23 (individually designated 23*a, b, c, d*, and *e*). However, it is to be understood that within the scope and contemplation of the invention are versions in which the brush head 20 is infinitely positionable between extreme "forward" and "rearward" operative positions. In each case, "lockdown mechanisms" are provided that reversibly "set" the brush head 20 within the brush-head mount 88 for use. In alternative versions, these mechanisms might include a spring-loaded pin 99 that is normally biased downwardly from the brush-handle bottom surface 74 toward the brush-head upper surface 22 for selective engagement with one of the detents 23 defined in the brush-head upper surface 22. In a version enabling infinite positionability, selective frictional engagement between the brush head 20 and the brush-head mount 88 may be relied upon.

With reference to FIG. 7B, in addition to FIGS. 7 and 7A, there is described a version in which the brush head 20 is selectively and reversibly "fixed" relative to the brush handle 70 through rotation of the grip portion 86. More specifically, in the version of FIGS. 7-7B, the grip portion 86 and brush-head mount 88 together define a hub $\mathbf{87}_{Hub}$ and axle $\mathbf{87}_{Axle}$ coaxially disposed and cooperatively engaged such that the brush-head mount 88 is selectively rotatable relative to grip portion 86 of the brush handle 70 between first and second angular orientations about a grip-rotation axis $A_{GR}$. The first angular orientation, as indicated in FIGS. 7 and 7A, is such that the handle axis $A_H$ and brush-head axis $A_{BH}$ are coplanar—at least substantially so—and the second angular orientation is such that the handle axis $A_H$ and brush-head axis $A_{BH}$ are non-coplanar, as shown in FIG. 7B.

With continued reference to FIGS. 7-7B, alternative versions are such that one of the first and second angular orientations corresponds to a "locked position" in which the brush head 20, when disposed between and on the tongues 52A and 52B, is restrained against axial displacement relative to the brush-head mount 88. In such a version, the other of the first and second angular positions that does not correspond to the locked position corresponds to an "unlocked position" in which the brush head 20 can be alternatively axially displaced relative to the brush-head mount 88 for insertion or removal therefrom. In the version of FIG. 7B, the second angular orientation is such that the handle and brush-head axes $A_H$ and $A_{BH}$ are mutually orthogonal.

The specific mechanisms by which rotation of the grip portion 86 relative to the brush-head mount 88 results in alternative "locked" and "unlocked" positions can vary among specific versions. In some cases, inclined surfaces and/or cams may be used such that, in a locked position, a surface depending from the brush head 20 frictionally engages with a surface depending from the brush-head mount 88. In other versions, a "keyed" first protrusion on one of the brush-head mount 88 and the brush head 20 may be brought into an "interference fit" with a notch or keyed second protrusion defined on the other of the brush 20 and brush-head mount 88 when the grip portion 86 is in the "locked" orientation. In the latter version, the interference fit would be cleared or eliminated when the handle is rotated into the unlocked position, thereby allowing the brush head 20 to be axially displaced relative to, and freed from, the brush-head mount 88. Provided with the aforesaid functional description, one of ordinary skill in the art to which the invention pertains could fashion such mechanisms without undue experimentation and, therefore, they are not separately illustrated or further described.

Figure 8:
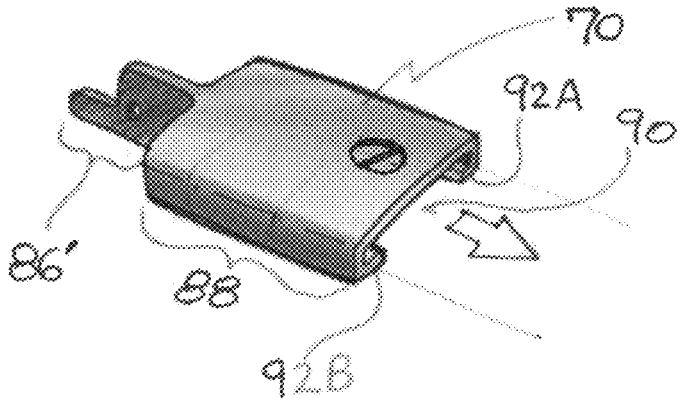
FIG. 8 depicts a brush handle in the form of a mounting adaptor mountable within a power tool.
Figure 9:
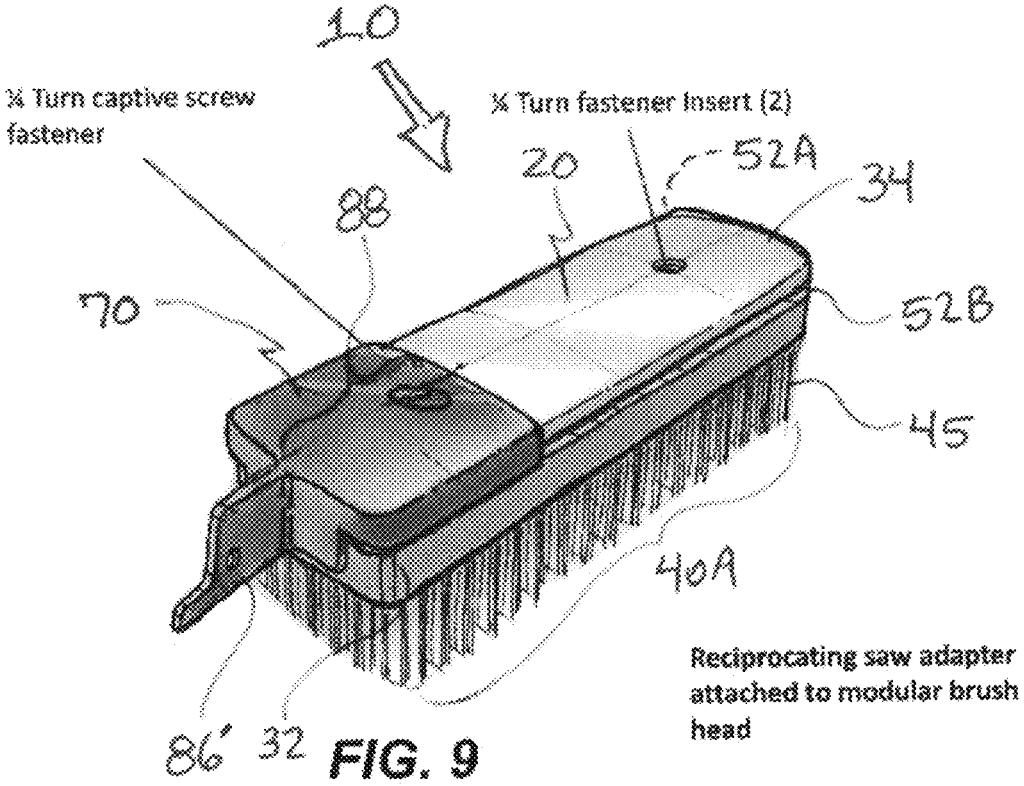
FIG. 9 shows the brush handle of FIG. 8 with a brush head selectively captured and retained thereby.

Referring now to FIGS. 8 and 9, there is shown an alternatively configured modular brush kit 10. In most respects, the modular brush 10 of FIGS. 8 and 9 is similar to that shown and described in association with FIGS. 1-3. Accordingly, as previously indicated, like or similar elements between the versions of FIGS. 1-3 and 8-9 are denoted by similar or identical references characters. Moreover, for the sake of brevity, elements in the version of FIGS. 8 and 9 that find correspondence with elements of the version of FIGS. 1-3 are given, at most, cursory descriptive treatment below; the description above associated with FIGS. 1-3 is regarded as sufficient to support an adequate explanation and enabling disclosure of the version of FIGS. 8 and 9. Accordingly, principal focus is placed on the respects in which the version of FIGS. 8 and 9 differs from that of FIGS. 1-3.

A principal difference between the version of FIGS. 8 and 9 and that of FIGS. 1-3 is that, in the version of FIGS. 8 and 9, the grip portion 86' of the brush handle 70 is not configured for grasping by a human hand. Instead, the grip portion 86' is configured for grasping by a power tool; for example, a reciprocating saw (not shown) of a type sometimes referred to as a "demolition reciprocating saw," a "demolition saw," or simply a "demo saw." For reference purposes, a common brand of such a saw is "Sawzall®," which, while actually a federally registered trademark of Milwaukee Tool or, more formally, the Milwaukee Electric Tool Corporation, is commonly misappropriated as the generic descriptor of the tool type in question. In this regard, the brush handle 70 of embodiments configured for mounting to a power tool can be thought of as a kind of mounting adaptor, and may be alternatively referred to as such, while using the same reference number "70."

As shown in both FIGS. 8 and 9, the grip portion 86' is configured similarly to the proximate end of a reciprocating saw blade (not shown). Neither a reciprocating saw nor a blade therefore of the general types described are shown because they are sufficiently ubiquitous and familiar. In any event, there is sufficient referential information included above for one to conduct a short internet search to ascertain the type of saw and blade in question such that the disclosure above is readily enabling to a person of ordinary skill in the art to which the present invention pertains.

In order to use the modular brush 10 as shown in FIG. 9, a user would mount within the blade receiver of a reciprocating demo saw the grip portion 86' in the same general manner in which a reciprocating saw blade would be so mounted. With the saw running, a user could engage a surface to be brushed with the bristles 45 of the brush head 20 retained by the brush-head mount 88 of the brush handle 70. Depending on the saw, or other blade-retaining power tool in question, the brush-head mount 88, and thus, the brush head 20, could be manipulated in reciprocal or orbital and/or vibratory motion. Moreover, while the configuration shown in FIGS. 8 and 9 is particularly well-suited for use generally "in-line" with a reciprocating saw such that the brush-head mount 88 extends generally forward of the saw, it will be readily appreciated that the brush-head mount 88 and grip portion 86' may be alternatively configured for disposition generally below a power tool that imparts orbital or vibratory motion, and that such configurations are within the scope and contemplation of the invention as claimed.

As previously indicated, most notably in connection with the handheld example of FIGS. 2 and 3, regardless of the particular configurations and mechanisms employed, a concern among various embodiments is preventing undesired lateral, longitudinal and angular displacement of the brush head 20 relative to the brush handle 70. Accordingly, in various embodiments, the brush head 20 and brush-head mount 88 are keyed for mutual selective interlock in order to prevent such undesired relative displacement. In the examples of FIGS. 1-9, complementarily keyed configurations are in the form of tongues 92A and 92B for axial-receipt (along the brush-head axis $A_{BH}$ and, in most cases, the handle axis $A_H$) by laterally opposed grooves 52A and 52B defined within, and extending longitudinally along, respectively, the brush-head first and second sides 36 and 38.

Figure 10:
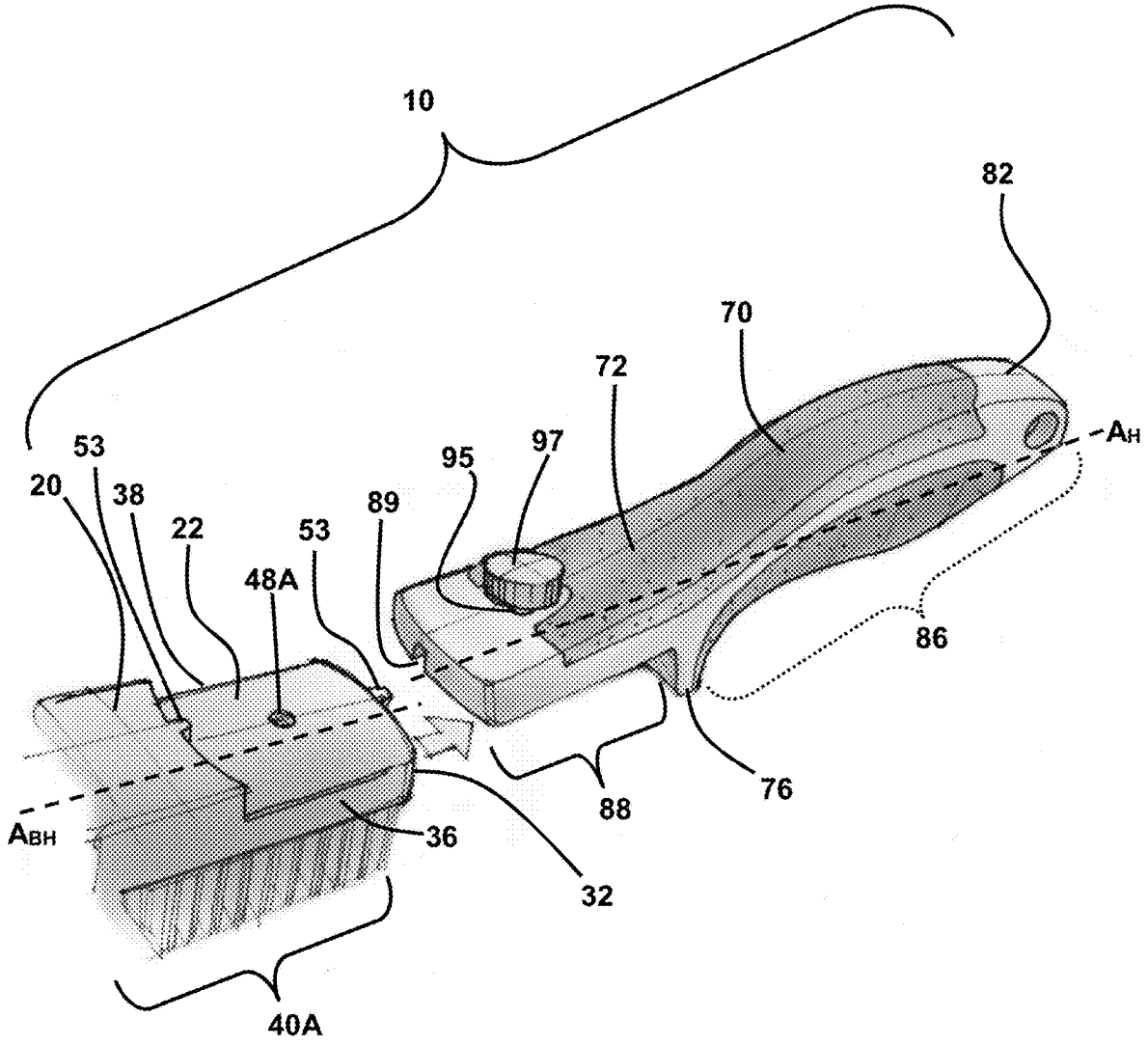
FIG. 10 is a perspective view of a reconfigurable modular brush in which the brush head and brush handle are configured alternatively to the illustrative brush head and brush handle of FIGS. 2 and 3, for example.

Shown in FIG. 10 is a reconfigurable modular brush 10 comprising a brush head 20 and brush handle 70 with complementary "keying" alternative to that of the tongue-and-grove arrangement previously described. The version of FIG. 10 is an example in which at least one of the brush head 20 and brush-head mount 88 includes a protuberance 53 and the other of the brush-head mount 88 and brush 20 includes a slot 89 (alternatively, "channel 89") for receiving the protuberance 53 such that, when the brush head 20 is selectively captured by the brush-head mount 88, undesired angular displacement is prevented. Of course, in a strict sense, the protuberance 53 can be regarded as a kind of tongue, while the slot 89 can be regarded as a kind of groove, but the example of FIG. 10 is nevertheless useful for suggesting an alternative approach within the scope of the overall objective of capturing and retaining the brush head 20 with the brush-head mount 88 of the brush handle 70.

With continued reference to FIG. 10, it is also noted that the fastener 95 used to retain the brush head 20 on the brush-head mount 88 includes a fastener knob 97 instead of a keyed fastener head 96, as in previous examples. While the fastener knob 97 is not recessed or flush relative to the brush-handle top surface 72 when retainably engaging the brush head 20, it does provide the advantage of not requiring a tool to turn it in order retain or release the brush head 20.

With respect to at least the illustrative embodiments discussed in conjunction with FIGS. 1-9, the act of connecting the brush head 20 to the brush handle 70 is restricted to longitudinal insertion of at least one tongue 92A and/or 92B depending from the brush-head bottom surface 74 into a respective at least one groove 52A or 52B defined along the brush head 20. The longitudinal insertion is generally along the lengthwise extent(s) of the brush-head axis $A_{BH}$ and the handle axis $A_H$ and, therefore, can also be conceptualized as axial insertion. While axial insertion is acceptable in a wide variety of circumstances, restriction to only that mode of insertion can be too restrictive in other contexts. Accordingly, there are subsequently disclosed and described herein alternative embodiments configured to allow the brush head 20 to be introduced/inserted into or onto the brush handle 70 in a direction that is substantially or "predominantly" perpendicular to the longitudinal reference axis, which reference axis is at least one of the brush-head axis $A_{BH}$ and the handle axis $A_H$. In less formal terms, and for reasons that will soon be apparent, the alternative modes of mutually directly coupling the brush head 20 and the brush handle 70 can be conceptualized as "back-to-front" coupling, which corresponds to the axial insertion mode, and top-down coupling, which corresponds to the non-axial (i.e., perpendicular) mode of coupling. Moreover, embodiments configured to facilitate both axial and perpendicular coupling may be said to facilitate "two-axis coupling" or "dual-mode coupling."

Relative to the two-axis or dual-mode coupling, it will be appreciated that, as long as the protuberances 53 and slots 89 are configured accordingly, the brush head 20 can be axially inserted into the brush handle 70—the mode of insertion indicted by the arrow in FIG. 10—or the brush handle 70 can be introduced top-down onto the brush-head upper surface 22 in order to introduce each protuberance 53 into its corresponding slot 89. The second mode of coupling is not expressly depicted relative to the illustrative embodiment of FIG. 10, but this latter coupling mode is adequately disclosed by virtue of the fact that it is readily envisioned by one of ordinary skill in the art to which the invention pertains and, indeed, even most casual observers.

Figures 11, 11A, 11B:
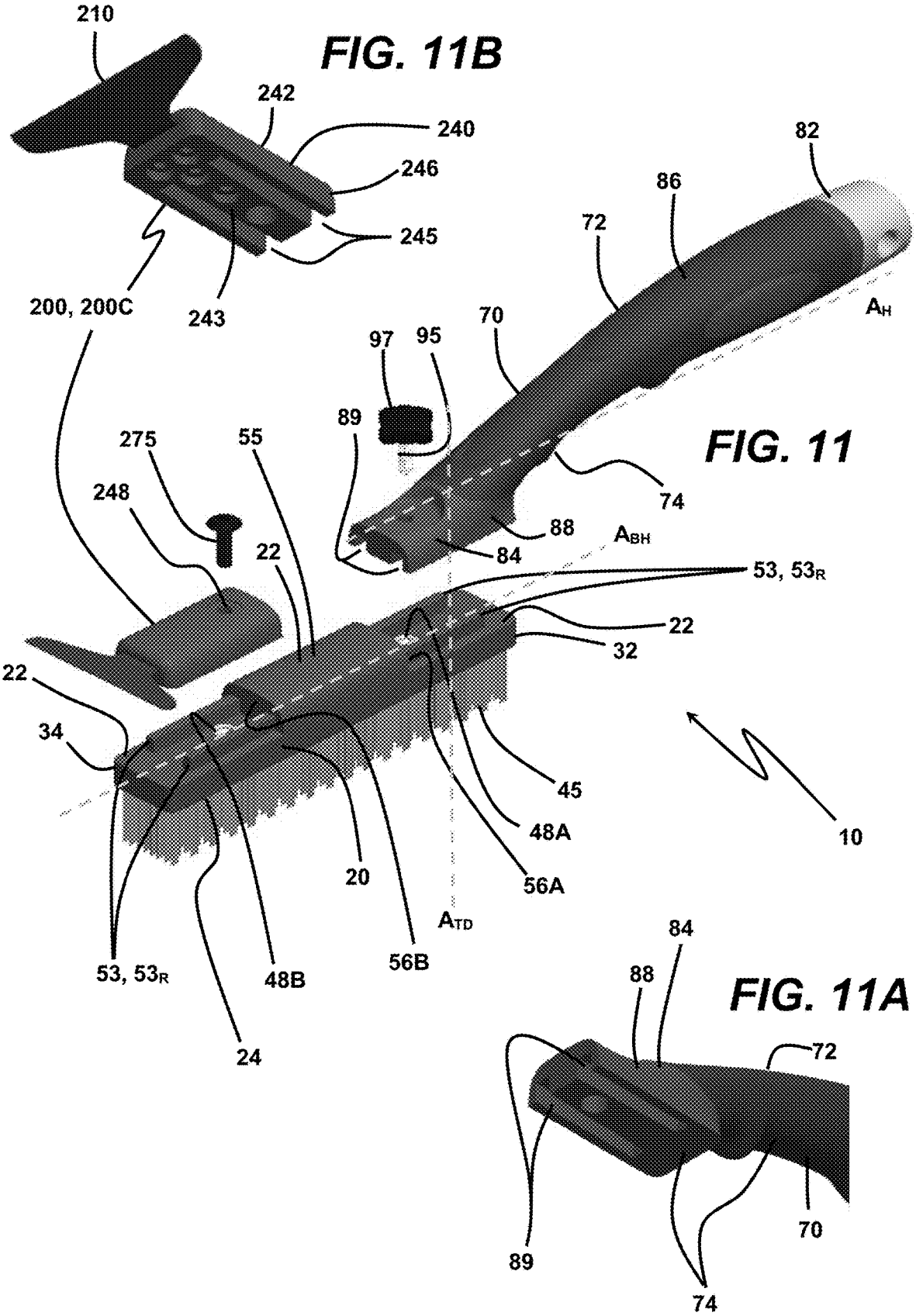
FIG. 11 is an exploded view of an alternatively configured modular brush in which handles and accessories can be coupled to the brush head by either (i) longitudinal/axial insertion or (ii) perpendicular (or top-down) coupling.
FIG. 11A is an underside detail view of an accessory that can be coupled to the brush head shown in FIG. 11.
FIG. 11B shows an underside detail a brush-head mount on a handle that can selectively couple with the brush head shown in FIG. 11.
Figure 12:
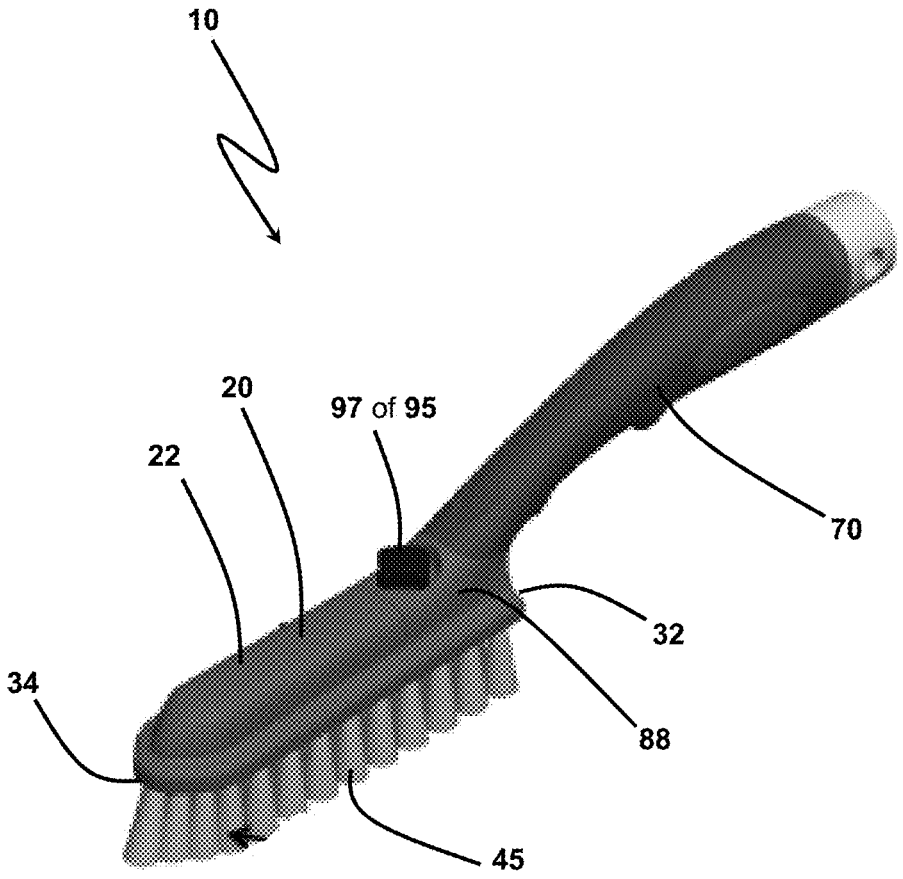
FIG. 12 shows a modular brush that in most respects is similar to that of FIG. 11, but which include a brush head with a tapered brush-head second end.
Figure 12A:
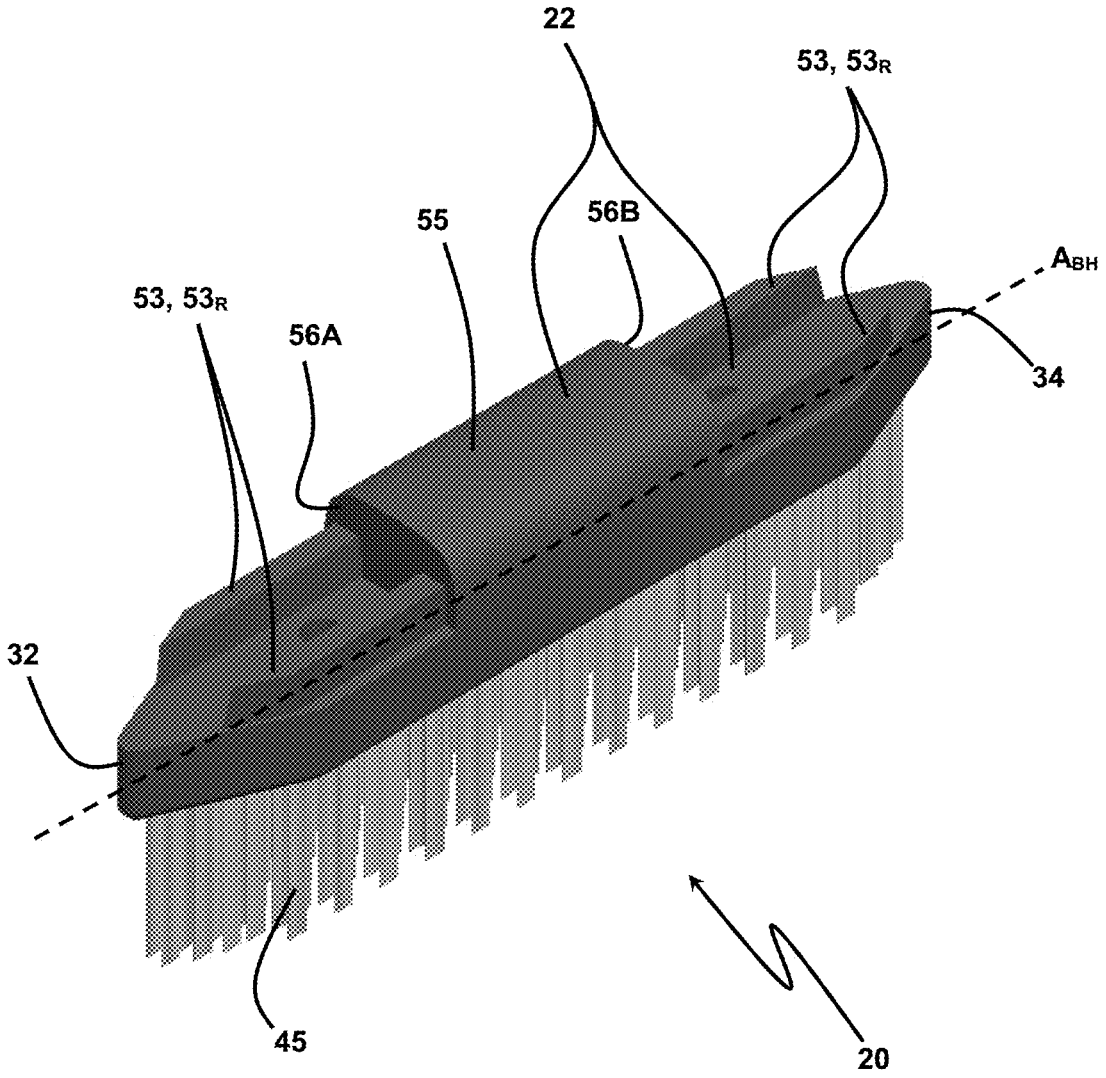
FIG. 12A depicts a brush head with two pairs of elongated rails and in which both the brush-head first and second ends are tapered.

Various embodiments of a modular brush 10 enabling two-axis coupling are shown FIGS. 11 through 13A. In many respects, the modular brushes 10 of FIGS. 11 through 12A are similar to that shown and described in association with FIGS. 1-3. Accordingly, as previously indicated in connection with other alternative embodiments, like or similar elements between the versions of FIGS. 1-3 and 11-12A are denoted by similar or identical references characters. Additionally, the versions of FIGS. 11-12A include elements that correspond to elements disclosed and described in connection with the illustrative embodiment of FIG. 10. For the sake of brevity, elements in the version of FIGS. 11-12A that find correspondence with elements of the version of FIGS. 1-3 and FIG. 10 are given, at most, cursory descriptive treatment below; the description above associated with FIGS. 1-3 and FIG. 10 is regarded as sufficient to support an adequate explanation and enabling disclosure of the version of FIGS. 11-12A. Accordingly, principal focus is placed on the respects in which the versions of FIGS. 11-12A differ from that of FIGS. 1-3.

As with versions previously discussed, each version of FIGS. 11-12A includes a brush head 20 having brush-head upper and lower surfaces 22 and 24 extending longitudinally along a brush-head axis $A_{BH}$ between brush-head first and second ends 32 and 34. Each modular brush 10 further includes a brush handle 70 having brush-handle top and bottom surfaces 72 and 74 which, while contoured, have a lengthwise extent disposed generally along a handle axis $A_H$ between handle proximate and distal ends 82 and 84. The brush handle 70 further includes a grip portion 86 configured for grasping by a human hand and a brush-head mount 88. The brush-head mount 88 and the brush head 20 are cooperatively configured such that the brush handle 70 can selectively capture and retain the brush head 20. As with embodiments previously considered, in each of the versions of FIGS. 11-12A the brush head 20 and brush-head mount 88 of the brush handle 70 are keyed for mutual selective interlock in order to prevent undesired relative displacement. However, like only certain variations of the embodiment of FIG. 10, each of the embodiments of FIGS. 11-12A is expressly configured to facilitate both axial and top-down coupling as these modes of mutually coupling the brush head 20 and brush handle 70 were previously defined in associated with the embodiment of FIG. 10.

FIGS. 11, 11A and 11B depict, respectively, an exploded view of a modular brush 10, a selectively attachable accessory 200 in the form of a scraper 200C, and an underside detail of the brush-head mount 88 of the brush handle 70 shown in FIG. 11. As in the example of FIG. 10, the brush-head upper surface 22 of the brush head 20 of FIG. 11 includes at least one protuberance 53. In the case of FIG. 11, the illustrative brush head 20 includes a total of four protuberances 53, arranged as two pairs on either side of a raised median 55. The protuberances 53 are in the form of elongated rails $\mathbf{53}_R$ extending longitudinally along the brush-head axis $A_{BH}$.

Referring specifically to FIGS. 11 and 11B, it can be seen that the brush-head mount 88 is complimentarily keyed in order to received and retain the brush head 20. More specifically, the brush-handle bottom surface 74 has defined there in—along the brush-head mount 88—a pair of elongated channels 89 mutually spaced and configured to receive the elongated rails $\mathbf{53}_R$ defined on the brush-head upper surface 22. Moreover, the elongated rails $\mathbf{53}_R$ and the elongated channels 89 are configured such that the brush-head mount 88 and the brush-head upper surface 22 can be brought into direct mutual contact, and the elongated rails $\mathbf{53}_R$ seated in the elongated channels 89 by either (i) longitudinal insertion of the elongated rails $\mathbf{53}_R$ into to the elongated channels 89 along the brush-head axis $A_{BH}$ or (ii) top-down mounting in a direction (i.e., along an axis) perpendicular to the brush-head axis $A_{BH}$. The "top-down" or "perpendicular" mode of mounting can be appreciated through examination of FIG. 11 in which the brush handle 70 and brush head 20 need only be brought into seating engagement by moving them toward one another along a top-down mounting axis $A_{TD}$ that is perpendicular to the brush-head axis $A_{BH}$.

Provided with the benefit of the preceding disclosure, a person of ordinary skill in the related art would readily appreciate that the elongated rails $\mathbf{53}_R$ and channels 89 need to be configured according to certain parameters. One configuration that would clearly function as intended calls for the sides of the rails $\mathbf{53}_R$ perpendicular to the brush-head upper surface 22 to be mutually parallel, and for the sides of the elongated channels 89 to also be mutually parallel and spaced apart by a distance sufficient to accommodate the seating of the elongated rails $\mathbf{53}_R$ therebetween. In the version of FIG. 11, the elongated rails $\mathbf{53}_R$ taper very slightly—almost imperceptibly—in moving upwardly and away from the brush-head upper surface 22 along which they are defined. The elongated channels 89 defined in and along the brush-handle bottom surface 74 and the brush-head mount 88 taper in a manner complimentary to the tapering of the elongated rails $\mathbf{53}_R$; that is, the elongated channels 89 taper very slightly in moving upwardly from the brush-handle bottom surface 74 toward the brush-handle top surface 72. In this way, as the brush head 20 and brush-head mount 88 are drawn toward one another by, for example, tightening of the fastener 95, the elongated rails $\mathbf{53}_R$ nest more tightly within the elongated channels 89, thereby preventing undesired angular or lateral displacement of the brush head 20 relative to the brush handle 70 when in use.

Figure 11C:
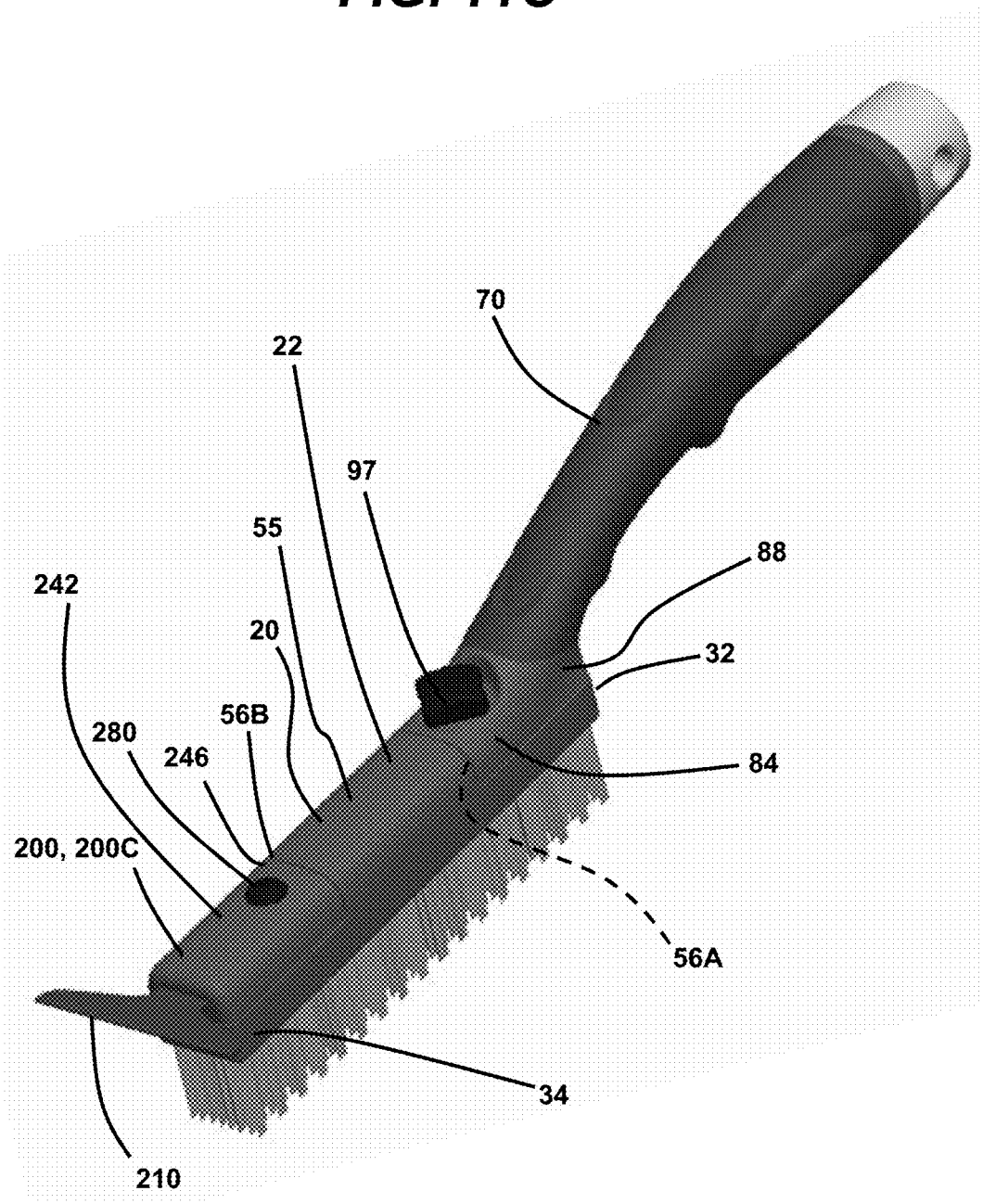
FIG. 11C shows the modular brush of FIG. 11 shown in an assembled state.

Previously mentioned was the raised median 55 situated between the two pairs of protuberances 53. The raised median 55 is defined in part by a portion of the brush-head upper surface 22 that is raised relative to portions of the brush-head upper surface 22 on either side of the raised median 55. At longitudinally opposed ends of the raised median 55 are defined first and second median-end walls 56A and 56B. With reference to the orientation of the brush head 20 relative to the brush handle 70 shown in FIG. 11, when the brush head 20 is joined with the brush handle 70, the extreme handle distal end 84 of the brush handle 70 is situated immediately adjacent the first median wall 56A, as shown in FIG. 11C. Moreover, as shown in FIG. 11C, the present embodiment is configured such that, when assembled, that portion of the brush-head upper surface 22 extending along the raised median 55 is flush with the portion of the brush-handle top surface 72 defining a portion of the brush-head mount 88. In this way, when assembled as shown FIG. 11C, the brush-head upper surface 22 and the specified portion of the brush-handle top surface 72 offer the appearance of a continuous and uniform surface. As is evident from FIG. 11, the brush head 20 is configured with a degree of symmetry about the raised median 55 sufficient to render the brush head 20 reversible within the brush handle 70.

As previously discussed in association with FIG. 6, various embodiments of a modular brush 10 within the scope and contemplation of the present invention are configured to selectively receive and temporarily retain implements or accessories on the brush-head end 32 or 34 not retained by the brush handle 70. By way of illustrative, non-limiting example, described in association with FIG. 6 were two alternative scrapers 200A and 200B that can be selectively attached to the depicted brush head 20. Each of the scrapers 200A and 200B in FIG. 6 has an accessory base 240 that is configured for selective mounting to the "free end" of the brush head 20 (i.e., that end 32 or 34 not retained by the brush handle 70) in a manner very similar to that in which the brush heads 20 of FIGS. 1-6 are attached to the brush handles 70 of FIGS. 1-6. However, as previously explained, all of those illustrative embodiments facilitate only longitudinal coupling of the brush head 20 with either the brush handle 70 or the accessories, such as scrapers 200A and 200B.

Referring to FIGS. 11 and 11B, there is shown a selectively attachable accessory 200 in the form of a scraper 200C. The scraper 200C is compatible with the brush head 20 in FIG. 11 in that, like the brush handle of FIG. 11, it can be coupled with the brush head 20 by either (i) longitudinal insertion or (ii) perpendicular (or top-down) coupling. To this end, the scraper 200C, which is illustrative of accessories more generally, includes an accessory base 240 configured for capture and retention by the brush head 20. The accessory base 240 has accessory-base upper and lower surfaces 242 and 243. Defined by and within the accessory-base lower surface 243 is a pair of elongated channels 245.

The elongated channels 245 defined within the accessory base 240 are analogous in form and function to the elongated channels 89 defined within the brush-head mount 88 of the brush handle 70. Accordingly, reference is made to the description of the brush-head mount 88 of FIGS. 11 and 11A in lieu of an exhaustive description of how the accessory of FIGS. 11 and 11B can be mounted to the brush head 20 of FIG. 11. As with the accessories previously described in association with FIG. 6, the scraper 200C may be releasably set by an accessory fastener 275 which may take a number of alternative forms including, by way of example, a pin, a "free" threaded fastener such as a screw, or a captive threaded fastener. In the example shown, the fastener 275 is a screw that is fed through an aperture 248 in the accessory base 240 and is threaded into fastener-receiving aperture 48B defined on the brush head 20.

With reference to the orientation of the brush head 20 relative to the scraper 200C shown in FIG. 11, when the brush head 20 is joined with the scraper 200C, an accessory-base rear end 246 of the scraper 200C is situated immediately adjacent the second median wall 56B, as shown in FIG. 11C. Moreover, as shown in FIG. 11C, the present embodiment is configured such that, when assembled, that portion of the brush-head upper surface 22 extending along the raised median 55 is flush with the accessory-base upper surface 242. In this way, when assembled as shown 11C, the brush-head upper surface 22 and the accessory-base upper surface 242 present the appearance of a continuous and uniform surface. As is evident from FIG. 11, the brush head 20 is configured with a degree of symmetry about the raised median 55 sufficient to render the brush handle 70 or the scraper 200C—or accessory 200 with similar configured accessory base 240—on either side of the raised median 55.

Figure 11D:
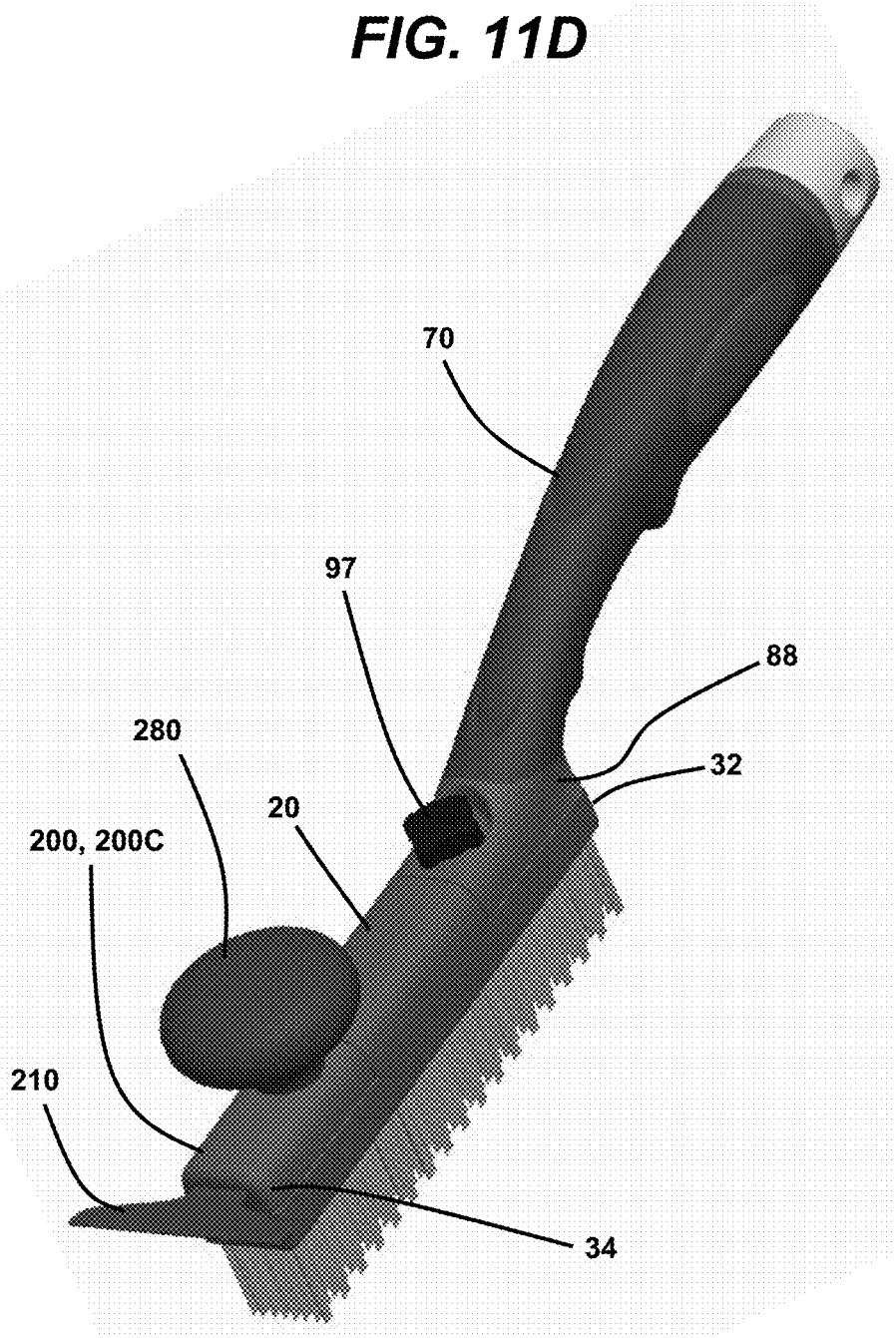
FIG. 11D shows the modular brush of FIG. 11C with an optional grasping knob that facilitates two-handed operation.

Referring to FIG. 11D, in order to facilitate use with two hands, the modular brush 10 optionally includes a grasping knob 280. The grasping knob 280 may be a part of an alternative fastener 275 used to retainer the accessory 200 onto the brush head 20, or it may thread into a hole (not shown) other than fastener-receiving aperture 48B.

Figure 11E:
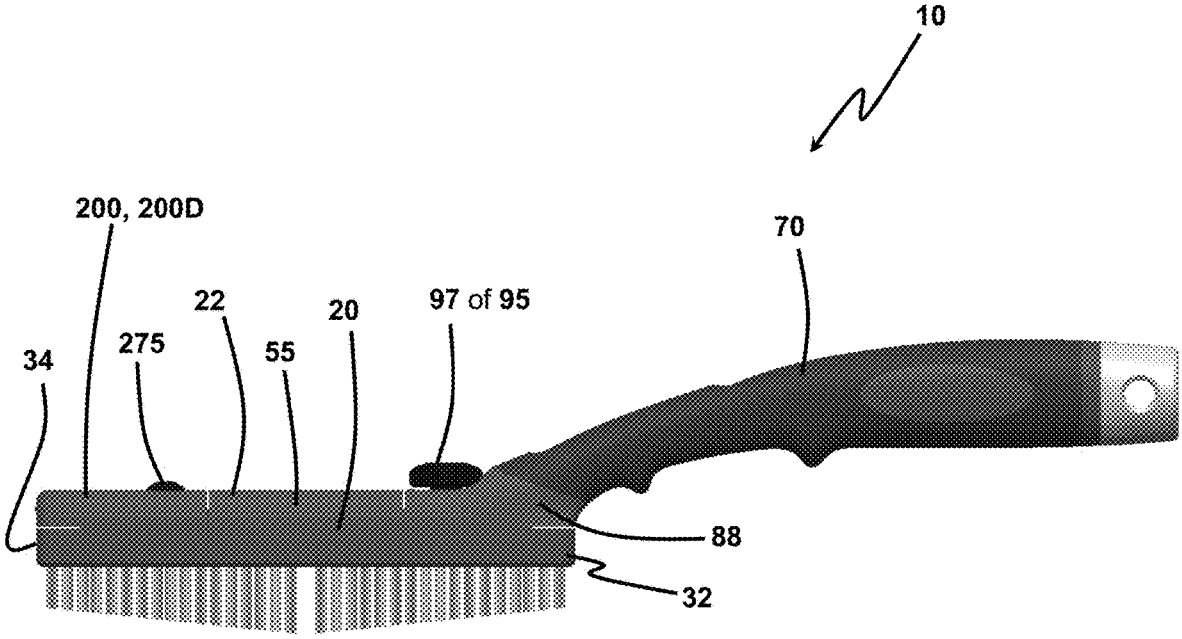
FIG. 11E is a left-side view of an assembled modular brush showing as an accessory a protective cap.

While among the examples of selectively mountable accessories 200 is the scraper 200C shown in FIGS. 11 and 11B, there is shown in FIG. 11E an alternative accessory 200 in the form of a protective cap 200D. The protective cap 200D is, in various versions, configured essentially as the accessory base 240 shown in FIGS. 11 and 11B, but lacks a scraping blade 210 or other implement. As shown in FIG. 11E, the main purposes of the protective cap 200D are to (i) cover and protect the elongated rails $\mathbf{53}_R$ defined on the brush-head upper surface 22 when a task-specific implement or a brush handle 70 is not otherwise mounted onto those rails $\mathbf{53}_R$ and (ii) contribute to the overall clean and uniform appearance of the modular brush 10 when no accessory 200 is mounted to the free end of the brush head 20.

FIGS. 12 and 12A merely show that embodiments otherwise similar to that of FIGS. 11-11D can incorporate and be used with brush heads 20 of various configurations. In the example of FIG. 12, a brush handle 70 is shown coupled with a brush head 20 having a tapered brush-head second end 34. Shown in FIG. 12 is a brush head 20 in which both the brush-head first and second ends 32 and 34 are tapered.

Discussed in conjunction with FIGS. 8 and 9 was a version in which the grip portion 86' of the brush handle 70 (aka, mounting adaptor 70) is not configured for grasping by a human hand. Instead, the grip portion 86' is configured for grasping by a power tool; for example, a reciprocating saw (not shown) of a type sometimes referred to as a "demolition reciprocating saw," a "demolition saw," or simply a "demo saw." More specifically, the grip portion 86' is configured in part similarly to the proximate end of a reciprocating saw blade (not shown). In the example of FIGS. 8 and 9, brush heads 20 are mounted in a manner analogous to the manner in which brush heads 20 are mounted to hand-held brush handles 70 in the embodiments of FIGS. 1-6, for example. Accordingly, brush heads 20 can be coupled with the mounting adaptor 70 of FIGS. 8 and 9 only by longitudinal or axial insertion as previously described.

Shown in FIGS. 13 and 13A is a mounting adaptor 70 that combines aspects of the mounting adaptor shown in FIGS. 8 and 9 with aspects of the accessories 200 and brush handle 70 shown in FIGS. 11-11B in order to render the mounting adaptor 70 usable with brush heads 20 such as those shown in FIGS. 11, 11C, 11D, 11E, and 12A, for example. As in other cases, where the embodiment presently under consideration includes components or elements analogous or similar in form and/or function to the components of previously discussed embodiments, such elements may be identified using the same or similar reference characters, even if they are not expressly discussed in connection with the embodiment presently under consideration. Like the brush handle 70 and accessory 200 of FIGS. 11-11B, the mounting adaptor 70 of FIGS. 13 and 13A is configured for coupling with a brush head 20.

The mounting adaptor 70 of FIGS. 13 and 13A is compatible with the brush head 20 in FIG. 11, and others like it, in that, like the brush handle of FIG. 11 and the accessories 200 of FIGS. 11 and 11B-D, for example, it can be coupled with the brush head 20 by either (i) longitudinal insertion or (ii) perpendicular (or top-down) coupling. To this end, while the mounting adaptor 70 includes a brush-head mount 88 configured for capture and retention by the brush head 20, the brush-head mount 88 is not configured like the brush-head mount 88 of the mounting adaptor in FIGS. 8 and 9, in which the keyed configurations are in the form of tongues 92A and 92B. Instead, defined by and within the brush-head mount 88 is a pair elongated channels 93 which are analogous in form and function to the elongated channels 245 of the accessory base 240 or scraper 200C and the elongated channels 89 defined in and along the brush-handle bottom surface 74 of the brush handle 70 of FIG. 11, for example. The mounting adaptor 70 of FIGS. 13 and 13A may be used in substantially the same manner in which the mounting adaptor 70 of FIGS. 8 and 9 can be used.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A reconfigurable modular brush comprising:

a brush head including brush-head upper and lower surfaces extending longitudinally along a brush-head axis between brush-head first and second ends and laterally opposed brush-head first and second sides extending between the brush-head upper and lower surfaces and longitudinally between the brush-head first and second ends;

a bristle array defined by a plurality of bristles protruding from the brush-head lower surface; and a brush handle including a grip portion configured for grasping by a human hand and a brush-head mount, the brush handle having a lengthwise extent disposed generally along a handle axis between handle proximate and distal ends, the brush head and brush-head mount being cooperatively configured such that the handle can selectively capture and retain the brush head, wherein the brush head is configured such that, when separated from the brush-head mount of the brush handle, the brush head can be grasped directly with a user's palm and multiple fingers of the same hand to engage a work surface, the brush head and the brush-head mount are complimentarily keyed such that the brush-head mount and the brush-head upper surface can be brought into direct contact for subsequent mutual interlocking by each of two methods including (i) longitudinal insertion along the brush-head axis and (ii) top-down mounting in a direction perpendicular to the brush-head axis, and each of the two methods of bringing the brush-head mount and the brush-head upper surface into direct contact can be performed both (i) exclusively of the other method and (ii) in combination with the other method.

2. The reconfigurable modular brush of claim 1 wherein the mutual selective interlock prevents undesired angular displacement of the brush head relative to the brush-head mount.

3. The reconfigurable modular brush of claim 2 wherein the longitudinal orientation in which the brush head is captured and retained by the brush handle is selectively reversible.

4. The reconfigurable modular brush of claim 3 wherein the brush-head first end is generally as wide as the brush head overall and the brush-head second end tapers toward a point.

5. A reconfigurable modular brush comprising:

a brush head including brush-head upper and lower surfaces extending longitudinally along a brush-head axis between brush-head first and second ends and laterally opposed brush-head first and second sides extending between the brush-head upper and lower surfaces and longitudinally between the brush-head first and second ends;

a bristle array defined by a plurality of bristles protruding from the brush-head lower surface; and a brush handle including a grip portion configured for grasping by a human hand and a brush-head mount, the brush handle having a lengthwise extent disposed generally along a handle axis between handle proximate and distal ends, the brush head and brush-head mount being cooperatively configured such that the handle can selectively capture and retain the brush head, and the brush head being itself further being configured as a hand brush such that, when separated from the brush-head mount of the brush handle, the brush head can be grasped directly with a user's palm and multiple fingers of the same hand to engage a work surface, wherein the brush head and the brush-head mount are complimentarily keyed such that the brush-head mount and the brush-head upper surface can be brought into direct mutual contact for selective capture of the brush head by the handle through each of two methods including (i) longitudinal insertion along the brush-head axis and (ii) top-down mounting in a direction perpendicular to the brush-head axis, and each of the two methods of bringing the brush-head mount and the brush-head upper surface into direct mutual contact can be performed both (i) exclusively of the other method and (ii) in combination with the other method.

6. The reconfigurable modular brush of claim 5 wherein the brush-head mount can alternatively capture and retain the brush head in a first longitudinal orientation and a second longitudinal orientation constituting the reverse of the first longitudinal orientation.

7. A reconfigurable modular brush comprising:

a brush head including brush-head upper and lower surfaces extending longitudinally along a brush-head axis between brush-head first and second ends and laterally opposed brush-head first and second sides extending between the brush-head upper and lower surfaces and longitudinally between the brush-head first and second ends;

a bristle array defined by a plurality of bristles protruding from the brush-head lower surface; and a brush handle in the form of an adaptor including a grip portion configured for grasping by a power tool and a brush-head mount, the brush handle having a lengthwise extent disposed generally along a handle axis between handle proximate and distal ends, wherein the brush head and brush-head mount are cooperatively configured such that the adaptor can selectively capture and retain the brush head, the brush head and brush-head mount are complimentarily keyed such that the brush-head mount and the brush-head upper surface can be brought into direct mutual contact for subsequent mutual interlocking by each of two methods including (i) longitudinal insertion along the brush-head axis and (ii) top-down mounting in a direction perpendicular to the brush-head axis, and each of the two methods of bringing the brush-head mount and the brush-head upper surface into direct mutual contact can be performed both (i) exclusively of the other method and (ii) in combination with the other method.

8. The reconfigurable modular brush of claim 7 wherein the mutual selective interlock prevents undesired angular displacement of the brush head relative to the brush-head mount.

9. The reconfigurable modular brush of claim 8 wherein the brush head is configured such that, when separated from the brush-head mount of the adaptor, the brush head can be grasped directly with a user's palm and multiple fingers of the same hand to engage a work surface.

10. The reconfigurable modular brush of claim 9 wherein the longitudinal orientation in which the brush head is captured and retained by the adaptor is reversible.

11. The reconfigurable modular brush of claim 8 wherein the longitudinal orientation in which the brush head is captured and retained by the adaptor is reversible.

* * * * *